US009810464B2

(12) United States Patent
Hatomura et al.

(10) Patent No.: US 9,810,464 B2
(45) Date of Patent: Nov. 7, 2017

(54) AIR-CONDITIONING APPARATUS WITH LOW OUTSIDE AIR TEMPERATURE MODE

(75) Inventors: Takeshi Hatomura, Tokyo (JP); Koji Yamashita, Tokyo (JP); Naofumi Takenaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 536 days.

(21) Appl. No.: 14/379,830

(22) PCT Filed: Apr. 27, 2012

(86) PCT No.: PCT/JP2012/002922

§ 371 (c)(1),
(2), (4) Date: Aug. 20, 2014

(87) PCT Pub. No.: WO2013/160965

PCT Pub. Date: Oct. 31, 2013

(65) Prior Publication Data

US 2015/0033780 A1 Feb. 5, 2015

(51) Int. Cl.
*F25B 30/02* (2006.01)
*F25B 49/02* (2006.01)
(Continued)

(52) U.S. Cl.
CPC ..... *F25B 49/02* (2013.01); *F25B 13/00* (2013.01); *F25B 30/02* (2013.01); *F25B 40/00* (2013.01);
(Continued)

(58) Field of Classification Search
CPC ..... F25B 2313/006; F25B 2313/02741; F25B 2313/0314; F25B 2400/0403;
(Continued)

(56) References Cited

U.S. PATENT DOCUMENTS 4,326,868 A * 4/1982 Ozu ..... F04C 29/042 417/284
2011/0023514 A1* 2/2011 Mitra ..... F25B 1/10 62/222

FOREIGN PATENT DOCUMENTS

EP 2 383 529 A1 11/2011
JP 06-341740 A 12/1994
(Continued)

OTHER PUBLICATIONS

Office Action dated Jul. 7, 2015 issued in corresponding JP patent application No. 2014-512032 (and English translation).
(Continued)

*Primary Examiner* — Jonathan Bradford
(74) *Attorney, Agent, or Firm* — Posz Law Group, PLC

(57) ABSTRACT

In a case of a heating operation in which the use side heat exchanger functions as a condenser when an outside temperature is a predetermined low temperature, a low-outside-temperature heating operation start-up mode in which, while a refrigerant discharged from the compressor is caused to flow into the use side heat exchanger, a refrigerant is supplied to the injection port of the compressor via the injection pipe and part of the refrigerant that has transferred heat in the heat source side heat exchanger is supplied to the compressor, is followed by a low-outside-temperature heating operation mode in which the refrigerant discharged from the compressor is supplied to the injection port of the compressor via the injection pipe while the refrigerant being caused to flow into the use side heat exchanger.

7 Claims, 8 Drawing Sheets

(51) Int. Cl.

| | |
|---|---|
| ***F25B 13/00*** | (2006.01) |
| ***F25B 40/00*** | (2006.01) |
| ***F25B 41/00*** | (2006.01) |
| ***F25B 41/04*** | (2006.01) |

(52) U.S. Cl.

CPC ..... *F25B 41/003* (2013.01); *F25B 41/043* (2013.01); *F25B 2313/0314* (2013.01); *F25B 2313/0315* (2013.01); *F25B 2400/05* (2013.01); *F25B 2400/13* (2013.01); *F25B 2500/31* (2013.01); *F25B 2600/0261* (2013.01); *F25B 2600/2519* (2013.01); *F25B 2700/1931* (2013.01); *F25B 2700/1933* (2013.01); *F25B 2700/2103* (2013.01); *F25B 2700/2104* (2013.01); *F25B 2700/21152* (2013.01)

(58) Field of Classification Search

CPC ..... F25B 2313/0409; F25B 2313/0411; F25B 2313/13; F25B 2600/2501; F25B 2600/2509

See application file for complete search history.

(56) References Cited

FOREIGN PATENT DOCUMENTS

| | | | |
|---|---|---|---|
| JP | 07-280378 | A | 10/1995 |
| JP | 2008-138921 | A | 6/2008 |
| WO | 2012/042573 | A1 | 4/2012 |

OTHER PUBLICATIONS

Extended European Search Report dated Mar. 1, 2016 issued in corresponding EP patent application No. 12875009.8.

Office Action dated May 12, 2016 issued in corresponding CN patent application No. 201280072642.1 (and English translation).

International Search Report of the International Searching Authority dated Jun. 26, 2012 for the corresponding international application No. PCT/JP2012/002922 (and English translation).

Office Action dated Sep. 30, 2015 in the corresponding CN application No. 201280072642.1 (with English translation).

Office Action dated Nov. 15, 2016 issued in corresponding CN patent application No. 201280072642.1 (and English translation).

* cited by examiner

AIR-CONDITIONING APPARATUS WITH LOW OUTSIDE AIR TEMPERATURE MODE

CROSS REFERENCE TO RELATED APPLICATIONS

This application is a U.S. national stage application of PCT/JP2012/002922 filed on Apr. 27, 2012, the contents of which are incorporated herein by reference.

TECHNICAL FIELD

The present invention relates to air-conditioning apparatuses applicable to, for example, multi-air-conditioning apparatuses used for buildings.

BACKGROUND

In existing air-conditioning apparatuses such as multi-air-conditioning apparatuses used for buildings, for example, outdoor devices (outdoor units) that are heat source devices installed outside the buildings and indoor devices (indoor units) installed inside the buildings are connected by pipes to form refrigerant circuits through which refrigerants circulate. Air is heated or cooled by utilizing heat transfer or heat removal of the refrigerants to heat or cool the spaces to be air-conditioned.

In a case where a heating operation is performed with such a multi-air-conditioning apparatus used for a building as described above at an outside air temperature below approximately −10 degrees C., the low-temperature outside air and the refrigerant undergo heat exchange. Thus, the evaporating temperature of the refrigerant decreases, and the evaporating pressure decreases accordingly.

Consequently, the density of the refrigerant that is sucked into a compressor decreases and the refrigerant flow rate decreases, resulting in an insufficient heating capacity of the air-conditioning apparatus. In addition, as the density of the refrigerant that is sucked into the compressor decreases, the compression ratio increases, causing an excessive increase in the temperature of the discharge refrigerant of the compressor. Thus, problems such as deterioration of refrigerating machine oil and damage to the compressor occur.

In order to address the problems described above, an air-conditioning apparatus has been proposed (see, for example, Patent Literature 1) which is configured to inject a two-phase refrigerant into a region with intermediate pressure in the compression process of the compressor to improve the density of the refrigerant to be compressed to increase the refrigerant flow rate so that sufficient heating capacity can be achieved when the outside temperature is low to reduce the discharge temperature of the compressor.

The technology described in Patent Literature 1 utilizes the fact that when the saturation temperature of a high-pressure refrigerant supplied to a load side heat exchanger becomes higher than or equal to the temperature of the indoor air, heat is transferred from the high-pressure gas refrigerant to the indoor air so that the refrigerant is liquefied and becomes a two-phase refrigerant, and injects the two-phase refrigerant into a region with intermediate pressure in the compression process of the compressor to reduce the discharge refrigerant temperature of the compressor.

Patent Literature

Patent Literature 1: Japanese Unexamined Patent Application Publication No. 2008-138921 (FIG. 1, FIG. 2, etc.)

When the outside air temperature is below approximately −10 degrees C. the temperature of the space to be air-conditioned where an indoor unit is installed also decreases correspondingly. That is, for a period of approximately 5 to 15 minutes immediately after the start of the air-conditioning apparatus, the saturation temperature of a high-pressure refrigerant supplied to a load side heat exchanger provided in the indoor unit is lower than the indoor air temperature. Thus, in the heating operation, even if a high-pressure refrigerant is supplied to the load side heat exchanger, the high-temperature, high-pressure gas refrigerant will not be liquefied in the load side heat exchanger.

In the technology described in Patent Literature 1, therefore, when the air-conditioning apparatus operates under a low outside air temperature condition, the gas refrigerant is injected into the compressor, resulting in a reduced effect of suppressing the increase in the temperature of the refrigerant discharged from the compressor. In addition, as the outside air temperature decreases (for example, −30 degrees C. or less), the density of the refrigerant to be sucked into the compressor decreases, resulting in an increase in the increase range of the discharge refrigerant temperature of the compressor.

Specifically, in the technology described in Patent Literature 1, the discharge refrigerant temperature of the compressor temporarily excessively increases to approximately 120 degrees C. or higher before the high-pressure refrigerant becomes higher than or equal to the indoor air temperature, causing problems of "deterioration of refrigerating machine oil" and "damage to the compressor due to wear of a slider in the compressor caused by the deterioration of the refrigerating machine oil".

In the technology described in Patent Literature 1, furthermore, the adoption of a method in which the speed of the compressor is reduced to reduce the rotation speed to suppress an increase in the discharge refrigerant temperature of the compressor may hinder a smooth increase in the speed of the compressor, causing a problem of increasing the time taken to achieve sufficient heating capacity and reducing user comfort.

SUMMARY

The present invention has been made in order to solve the foregoing problems, and it is an object of the present invention to provide an air-conditioning apparatus that suppresses an increase in the discharge refrigerant temperature of a compressor while suppressing a reduction in user comfort.

An air-conditioning apparatus according to the present invention is an air-conditioning apparatus having a refrigeration cycle in which a compressor, a refrigerant flow switching device, a heat source side heat exchanger, a use side expansion device, and a use side heat exchanger are connected to one another using a refrigerant pipe. The air-conditioning apparatus includes an injection pipe having one side connected to an injection port of the compressor, and another side connected to the refrigerant pipe between the use side expansion device and the heat source side heat exchanger, the injection pipe being configured to inject a refrigerant during a compression operation of the compressor; and a refrigerant heat exchanger configured to exchange heat between the refrigerant flowing through a refrigerant pipe in the refrigeration cycle and the refrigerant flowing through the injection pipe. In a case of a heating operation in which the use side heat exchanger functions as a condenser when an outside temperature is a predetermined low temperature, a low-outside-temperature heating operation start-up mode is executed in which, while a flow of the refrigerant discharged from the compressor is caused to flow into the use side heat exchanger, a flow of the refrigerant is supplied to the injection port of the compressor via the injection pipe and part of the refrigerant that has transferred heat in the heat source side heat exchanger is supplied to the compressor, and thereafter a low-outside-temperature heating operation mode is executed in which the flow of the refrigerant discharged from the compressor is supplied to the injection port of the compressor via the injection pipe while the refrigerant being caused to flow into the use side heat exchanger.

According to an air-conditioning apparatus of the present invention, in the case of a heating operation in which a use side heat exchanger functions as a condenser when the outside temperature is a predetermined low temperature, a low-outside-temperature heating operation start-up mode is followed by a low-outside-temperature heating operation mode. Thus, it is possible to suppress an increase in the discharge refrigerant temperature of a compressor while suppressing a reduction in user comfort.

DETAILED DESCRIPTION

Embodiment 1

Embodiments of the present invention will be described hereinafter with reference to the drawings.

Figure 1:
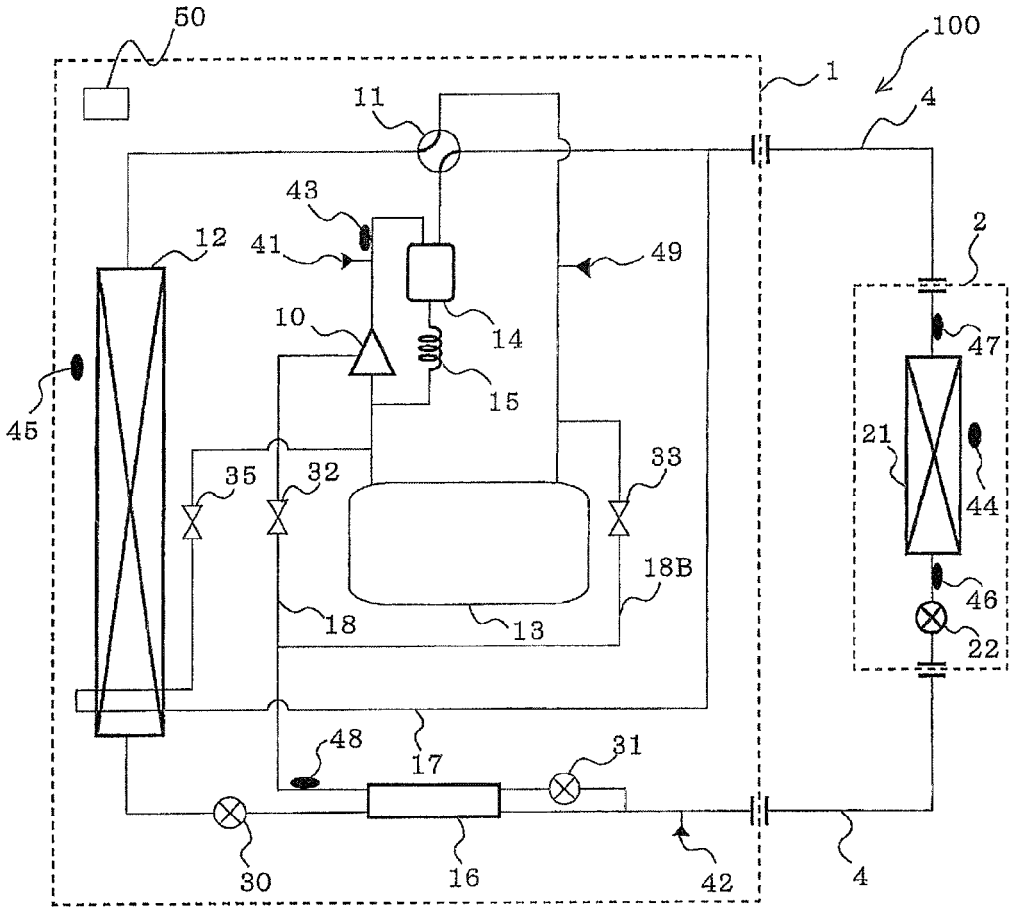
FIG. 1 is a schematic circuit configuration diagram illustrating an example of a circuit configuration of an air-conditioning apparatus according to Embodiment 1 of the present invention.

FIG. 1 is a schematic circuit configuration diagram illustrating an example of a circuit configuration of an air-conditioning apparatus (hereinafter referred to as 100) according to Embodiment 1. A detailed configuration of the air-conditioning apparatus 100 will be described with reference to FIG. 1. In the air-conditioning apparatus 100, an outdoor unit 1 and an indoor unit 2 are connected to each other using main refrigerant pipes 4, and a refrigerant circulates therebetween to enable air conditioning utilizing a refrigeration cycle.

The air-conditioning apparatus 100 is an improved version that suppresses an increase in the discharge refrigerant temperature of a compressor even when the outside air temperature is low while suppressing a reduction in user comfort.

[Outdoor Unit 1]

The outdoor unit 1 includes a compressor 10 having an injection port, a refrigerant flow switching device 11 such as a four-way valve, a heat source side heat exchanger 12, an accumulator 13 for reserving the surplus refrigerant, an oil separator 14 for separating refrigerating machine oil included in the refrigerant, an oil return pipe 15 having one side connected to the oil separator 14 and the other side connected to the suction side of the compressor 10, a refrigerant heat exchanger 16 such as a double-pipe heat exchanger, and a first expansion device 30, and these elements are connected to one another using the main refrigerant pipes 4.

An injection pipe 18 is connected to the main refrigerant pipe 4 between the refrigerant heat exchanger 16 and the indoor unit 2 for injection into an intermediate compression chamber in the compressor 10, and a second expansion device 31, the refrigerant heat exchanger 16, and a first opening and closing device 32 are connected in the injection pipe 18 in series with one another. A branching pipe 18B through which a refrigerant is supplied to a refrigerant inlet side of the accumulator 13 is connected to the injection pipe 18, and a second opening and closing device 33 is connected to the branching pipe 18B. The second expansion device 31 and the injection pipe 18 are disposed in the outdoor unit 1.

The outdoor unit 1 has a bypass pipe 17 for bypassing the discharge side of the compressor 10 and the suction side of the compressor 10 via the heat source side heat exchanger 12 during the heating operation. A third opening and closing device 35 for adjusting the flow rate is connected to the bypass pipe 17.

The outdoor unit 1 is provided with a first temperature sensor 43, a second temperature sensor 45, and a third temperature sensor 48 to detect temperatures of a refrigerant, a first pressure sensor 41, a second pressure sensor 42, and a third pressure sensor 49 to detect pressures of a refrigerant, and a controller 50 to control the rotation speed and the like of the compressor 10 based on these detected pieces of information.

The compressor 10 is configured to suck a refrigerant and compress the refrigerant to produce a high-temperature, high-pressure state, and may be constructed with, for example, a capacity-controllable inverter compressor or the like. The discharge side of the compressor 10 is connected to the refrigerant flow switching device 11 via the oil separator 14, and the suction side of the compressor 10 is connected to the accumulator 13. The compressor 10 has an intermediate compression chamber, and the injection pipe 18 is connected to the intermediate compression chamber.

The refrigerant flow switching device 11 is configured to switch between the flow of refrigerant in a heating operation mode and the flow of refrigerant in a cooling operation mode. In the cooling operation mode, the refrigerant flow switching device 11 performs switching so as to connect the discharge side of the compressor 10 and the heat source side heat exchanger 12 via the oil separator 14 and further connect the accumulator 13 and the indoor unit 2. In the heating operation mode, the refrigerant flow switching device 11 performs switching so as to connect the discharge side of the compressor 10 and the indoor unit 2 via the oil separator 14 and further connect the heat source side heat exchanger 12 and the accumulator 13.

The heat source side heat exchanger 12 functions as an evaporator during the heating operation and functions as a condenser during the cooling operation to exchange heat between the air supplied from an unillustrated air-sending device such as a fan and the refrigerant. The heat source side heat exchanger 12 has one side connected to the refrigerant flow switching device 11, and the other side connected to the first expansion device 30. The heat source side heat exchanger 12 is further connected to the bypass pipe 17 so as to allow heat exchange between the refrigerant supplied from the bypass pipe 17 and the air supplied from the air-sending device such as a fan.

The accumulator 13 is disposed on the suction side of the compressor 10, and is configured to accumulate the surplus refrigerant caused by a difference between the heating operation mode and the cooling operation mode or the surplus refrigerant caused by a transient change in operation. The accumulator 13 has one side connected to the suction side of the compressor 10, and the other side connected to the refrigerant flow switching device 11.

The oil separator 14 is configured to separate a mixture of refrigerant and refrigerating machine oil discharged from the compressor 10. The oil separator 14 is connected to the discharge side of the compressor 10, the refrigerant flow switching device 11, and the oil return pipe 15.

The oil return pipe 15 is configured to return the refrigerating machine oil to the compressor 10, and part of the oil return pipe 15 may be constructed with a capillary tube or the like. The oil return pipe 15 has one side connected to the oil separator 14, and the other side connected to the suction side of the compressor 10.

The refrigerant heat exchanger 16 is configured to exchange heat between refrigerants, and is constructed with, for example, a double-pipe heat exchanger or the like. The refrigerant heat exchanger 16 sufficiently ensures the degree of subcooling of the high-pressure refrigerant during the cooling operation, and adjusts the quality of the refrigerant to flow into the injection port of the compressor 10 during a low-outside-temperature heating operation. The refrigerant heat exchanger 16 has one refrigerant passage side connected to the main refrigerant pipe 4 connecting the first expansion device 30 and the indoor unit 2, and the other refrigerant passage side connected to the injection pipe 18.

The first expansion device 30 is configured to adjust the pressure of the refrigerant to flow into the heat source side heat exchanger 12 in the heating operation mode. The first expansion device 30 has one side connected to the refrigerant heat exchanger 16, and the other side connected to the heat source side heat exchanger 12.

The second expansion device 31 is configured to adjust the pressure of the refrigerant to flow into the injection port of the compressor 10 during the low-outside-temperature heating operation. The second expansion device 31 has one side connected to the main refrigerant pipe 4 connecting the refrigerant heat exchanger 16 and the indoor unit 2, and the other side connected to the refrigerant heat exchanger 16.

The first expansion device 30 and the second expansion device 31 have each a function of a pressure reducing valve or an expansion valve to reduce the pressure of a refrigerant to expand the refrigerant. The first expansion device 30 and the second expansion device 31 may be each constructed with a device having a variably controllable opening degree, such as an electronic expansion valve.

The injection pipe 18 is configured to connect the main refrigerant pipe 4 connecting the indoor unit 2 and the refrigerant heat exchanger 16 to the compressor 10. The injection pipe 18 is further connected to the branching pipe 18B. The branching pipe 18B is provided with the second opening and closing device 33, and has one side connected to the main refrigerant pipe 4 on the refrigerant inlet side of the accumulator 13, and the other side connected to the injection pipe 18.

The injection pipe 18 is provided with the first opening and closing device 32 to adjust a flow rate. The first opening and closing device 32 is configured to adjust the amount of refrigerant to flow into the injection port of the compressor 10, and the second opening and closing device 33 is configured to adjust the amount of refrigerant to be supplied to the inlet side of the accumulator 13.

The injection pipe 18, the refrigerant heat exchanger 16, the second expansion device 31, the first opening and closing device 32, and the second opening and closing device 33 allow the air-conditioning apparatus 100 to "adjust the amount of refrigerant to flow into the injection port of the compressor 10 from the refrigerant heat exchanger 16 during the low-outside-temperature heating operation", and further allow the air-conditioning apparatus 100 to "adjust the flow rate of the low-pressure refrigerant, achieve the desired degree of subcooling of the high-pressure refrigerant, and bypass the refrigerant to the inlet side of the accumulator 13 during the cooling operation".

The bypass pipe 17 is a pipe connected so as to bypass the discharge side of the compressor 10 and the suction side of the compressor 10 via the heat source side heat exchanger 12 during the heating operation. More specifically, the bypass pipe 17 has one side connected to the main refrigerant pipe 4 connecting the refrigerant flow switching device 11 and the indoor unit 2, and the other side connected to the main refrigerant pipe 4 connecting the accumulator 13 and the suction side of the compressor 10. The bypass pipe 17 is provided to extend through the heat source side heat exchanger 12 so as to allow the refrigerant flowing through the heat source side heat exchanger 12 to undergo heat exchange.

The bypass pipe 17 is provided with the third opening and closing device 35 to adjust an amount of refrigerant. The third opening and closing device 35 is configured to adjust the flow of a high-pressure liquid subjected to have heat exchanged in the heat source side heat exchanger 12, or a two-phase refrigerant, which is supplied to the suction side of the compressor 10.

The first opening and closing device 32, the second opening and closing device 33, and the third opening and closing device 35 may be each constructed with a device capable of adjusting the opening degree of a refrigerant passage, such as a two-way valve, a solenoid valve, or an electronic expansion valve.

The first temperature sensor 43 is disposed in the main refrigerant pipe 4 used for connection between the discharge side of the compressor 10 and the oil separator 14, and is configured to detect the temperature of the refrigerant discharged from the compressor 10. The second temperature sensor 45 is disposed in an air suction unit of the heat source side heat exchanger 12, and is configured to measure the ambient air temperature of the outdoor unit 1. The third temperature sensor 48 is disposed in the injection pipe 18 used for connection between the refrigerant heat exchanger 16 and the first opening and closing device 32, and is configured to detect the temperature of the refrigerant that has flowed into the injection pipe 18 and that has flowed out of the refrigerant heat exchanger 16 via the second expansion device 31. The first temperature sensor 43, the second temperature sensor 45, and the third temperature sensor 48 may be each constructed with, for example, a thermistor or the like.

The first pressure sensor 41 is disposed in the main refrigerant pipe 4 used for connection between the compressor 10 and the oil separator 14, and is configured to detect the pressure of the high-temperature, high-pressure refrigerant compressed by and discharged from the compressor 10. The second pressure sensor 42 is disposed in the main refrigerant pipe 4 connecting the indoor unit 2 and the refrigerant heat exchanger 16, and is configured to detect the pressure of a low-temperature, intermediate-pressure refrigerant that flows into the first expansion device 30. The third pressure sensor 49 is disposed in the main refrigerant pipe 4 connecting the refrigerant flow switching device 11 and the accumulator 13, and is configured to detect the pressure of the low-pressure refrigerant.

The controller 50 is configured to control the overall operation of the air-conditioning apparatus 100, and is constructed with a microcomputer or the like. The controller 50 controls, in accordance with detected information obtained by various detecting means and an instruction from a remote control, the driving frequency of the compressor 10, the rotation speed (including ON/OFF) of the fan (not illustrated) used for the heat source side heat exchanger 12 and the use side heat exchanger 21, the switching operation of the refrigerant flow switching device 11, the opening degree of the first expansion device 30, the opening degree of the second expansion device 31, the opening degree of third expansion device 22, the opening/closing of the first opening and closing device 32, the opening/closing of the second opening and closing device 33, the opening/closing of the third opening and closing device 35, and so forth to execute each of the operation modes described below. The controller 50 may be provided for each unit, or may be provided in either the outdoor unit 1 or the indoor unit 2

[Indoor Unit 2]

In the indoor unit 2, a use side heat exchanger 21 and a third expansion device 22 are installed. The indoor unit 2 is further provided with a fourth temperature sensor 46, a fifth temperature sensor 47, and a sixth temperature sensor 44 to detect temperatures of a refrigerant.

The use side heat exchanger 21 is connected to the outdoor unit 1 via the main refrigerant pipes 4 so that a refrigerant to flow thereinto or flow therefrom. The use side heat exchanger 21 is configured to exchange heat between, for example, the air supplied from an unillustrated air-sending device such as a fan and the refrigerant to generate air for heating use or air for cooling use which is supplied to an indoor space.

The third expansion device 22 has a function of a pressure reducing valve or an expansion valve to reduce the pressure of a refrigerant to expand the refrigerant, and is disposed on the upstream side of the use side heat exchanger 21 in the flow of a refrigerant in the cooling operation mode. The third expansion device 22 may be constructed with a device having a variably controllable opening degree, such as an electronic expansion valve.

The fourth temperature sensor 46 is disposed in a pipe used for connection between the third expansion device 22 and the use side heat exchanger 21, and the fifth temperature sensor 47 is disposed in a pipe connecting the use side heat exchanger 21 and the refrigerant flow switching device 11. The fourth temperature sensor 46 and the fifth temperature sensor 47 are configured to detect the temperature of a refrigerant that flows into the use side heat exchanger 21 or the temperature of a refrigerant that has flowed out of the use side heat exchanger 21. The sixth temperature sensor 44 is disposed in an air suction unit of the use side heat exchanger 21. The fourth temperature sensor 46, the fifth temperature sensor 47, and the sixth temperature sensor 44 may be each constructed with, for example, a thermistor or the like.

Although FIG. 1 illustrates the air-conditioning apparatus 100 that is provided with one indoor unit 2, the embodiments herein are not limited to this configuration. That is, the air-conditioning apparatus 100 is provided with a plurality of indoor units 2 connected in parallel to the outdoor unit 1, and is capable of selecting a "cooling operation mode in which all the indoor units 2 perform a cooling operation" or a "heating operation mode in which all the indoor units 2 perform a heating operation" which will be described below.

The following description will be given of the individual operation modes executable by the air-conditioning apparatus 100. The air-conditioning apparatus 100 implements the cooling operation mode or the heating operation mode in accordance with an instruction from the indoor unit 2. Each operation mode will be described hereinafter together with the flow of a refrigerant.

[Cooling Operation Mode]

Figure 2:
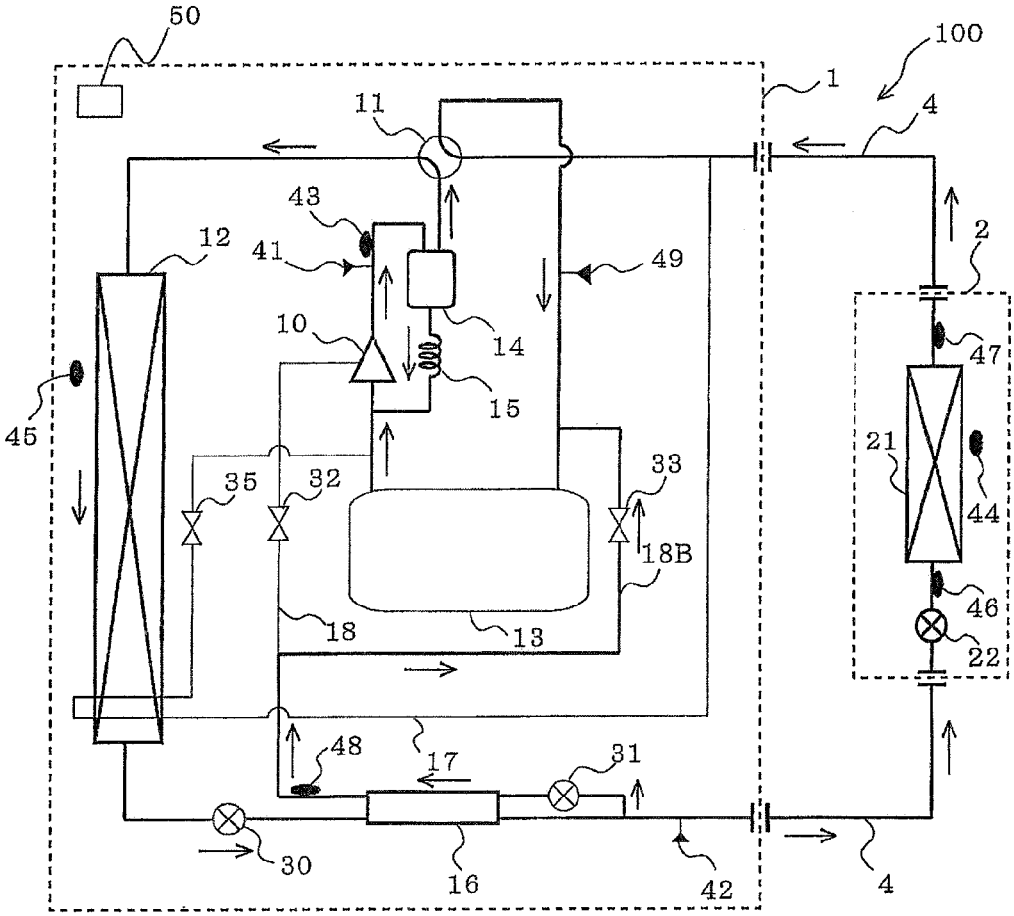
FIG. 2 is a refrigerant circuit diagram illustrating the flow of a refrigerant in a cooling operation mode of the air-conditioning apparatus according to Embodiment 1 of the present invention.

FIG. 2 is a refrigerant circuit diagram illustrating the flow of a refrigerant in a cooling operation mode of the air-conditioning apparatus 100 according to Embodiment 1. In FIG. 2, a description will be given of the cooling operation mode in the context of a cooling load having been generated in the use side heat exchanger 21, by way of example. In FIG. 2, the direction of the flow of a refrigerant is indicated by a solid arrow.

In the cooling operation mode illustrated in FIG. 2, a low-temperature, low-pressure refrigerant is compressed by the compressor 10 and becomes a high-temperature, high-pressure gas refrigerant which is then discharged. The high-temperature, high-pressure gas refrigerant discharged from the compressor 10 is separated by the oil separator 14 into a high-temperature, high-pressure gas refrigerant and a refrigerating machine oil, and only the high-temperature, high-pressure gas refrigerant flows into the heat source side heat exchanger 12 via the refrigerant flow switching device 11. The refrigerating machine oil separated by the oil separator 14 flows in from the suction side of the compressor 10 via the oil return pipe 15.

The high-temperature, high-pressure gas refrigerant that flows into the heat source side heat exchanger 12 become a high-pressure liquid refrigerant while transferring heat to the outdoor air in the heat source side heat exchanger 12. The high-pressure refrigerant flowing out of the heat source side heat exchanger 12 flows into the refrigerant heat exchanger 16 via the first expansion device 30 which is substantially fully open in terms of opening degree. Then, the high-pressure refrigerant branches at the outlet of the refrigerant heat exchanger 16 into a high-pressure liquid refrigerant that flows out of the outdoor unit 1 and a high-pressure liquid refrigerant that flows into the second expansion device 31.

Here, the high-pressure liquid refrigerant that flows out of the outdoor unit 1 transfers heat, in the refrigerant heat exchanger 16, to a low-pressure, low-temperature refrigerant subjected to pressure reduction by the second expansion device 31, and, as a result, becomes a subcooled high-pressure liquid refrigerant.

On the other hand, the high-pressure liquid refrigerant that flows into the second expansion device 31 is subjected to pressure reduction to a low-pressure, low-temperature refrigerant by the second expansion device 31, then removes heat, in the refrigerant heat exchanger 16, from the high-pressure liquid refrigerant flowing out of the first expansion device 30, and, as a result, becomes a low-pressure gas refrigerant. The low-pressure gas refrigerant flows into the accumulator 13 via the second opening and closing device 33. The first opening and closing device 32 is closed, and the refrigerant is not injected into the compressor 10.

The high-pressure liquid refrigerant flowing out of the outdoor unit 1 travels through the main refrigerant pipe 4, and is expanded into a low-temperature, low-pressure two-phase refrigerant by the third expansion device 22. The two-phase refrigerant flows into the use side heat exchanger 21 operating as an evaporator, removes heat from the indoor air, and, as a result, becomes a low-temperature, low-pressure gas refrigerant while cooling the indoor air. The gas refrigerant flowing out of the use side heat exchanger 21 travels through the main refrigerant pipe 4, and again flows into the outdoor unit 1. The refrigerant flowing into the outdoor unit 1 travels through the refrigerant flow switching device 11 and the accumulator 13, and is again sucked into the compressor 10.

Here, the opening degree of the second expansion device 31 is controlled so that superheat (the degree of superheat), which is obtained as the difference between the refrigerant saturation temperature calculated from the pressure detected by the third pressure sensor 49 and the temperature detected by the third temperature sensor 48, becomes constant. Furthermore, the opening degree of the third expansion device 22 is controlled so that superheat (the degree of superheat), which is obtained as the difference between the temperature detected by the fourth temperature sensor 46 and the temperature detected by the fifth temperature sensor 47, becomes constant.

[Heating Operation Mode]

Figure 3:
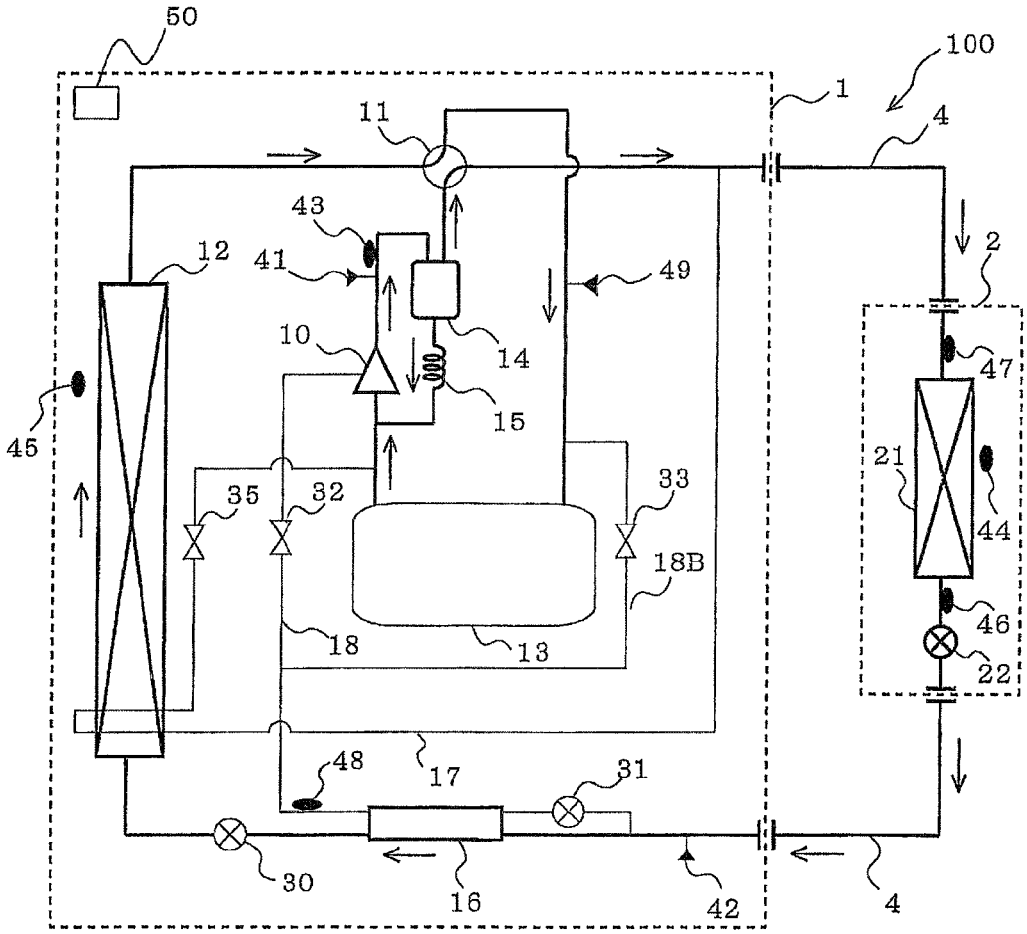
FIG. 3 is a refrigerant circuit diagram illustrating the flow of a refrigerant in a heating operation mode of the air-conditioning apparatus according to Embodiment 1 of the present invention.

FIG. 3 is a refrigerant circuit diagram illustrating the flow of a refrigerant in a heating operation mode of the air-conditioning apparatus 100 according to Embodiment 1. The illustrated heating operation mode is implemented when the outside air temperature is comparatively high (for example, 5 degrees C. or higher). In FIG. 3, the direction of the flow of a refrigerant is indicated by a solid arrow.

In the heating operation mode illustrated in FIG. 3, a low-temperature, low-pressure refrigerant is compressed by the compressor 10 and becomes a high-temperature, high-pressure gas refrigerant which is then discharged. The high-temperature, high-pressure gas refrigerant discharged from the compressor 10 is separated by the oil separator 14 into a high-temperature, high-pressure gas refrigerant and a refrigerating machine oil, and only the high-temperature, high-pressure gas refrigerant flows out of the outdoor unit 1 via the refrigerant flow switching device 11. The refrigerating machine oil separated by the oil separator 14 flows in from the suction side of the compressor 10 via the oil return pipe 15.

The high-temperature, high-pressure gas refrigerant flowing out of the outdoor unit 1 travels through the main refrigerant pipe 4, transfers heat, in the use side heat exchanger 21, to the indoor air, and, as a result, becomes a liquid refrigerant while heating the indoor air. The liquid refrigerant flowing out of the use side heat exchanger 21 is expanded by the third expansion device 22 and becomes a low-temperature, intermediate-pressure two-phase or liquid refrigerant which travels through the main refrigerant pipe 4 and again flows into the outdoor unit 1.

The low-temperature, intermediate-pressure two-phase or liquid refrigerant flowing into the outdoor unit 1 travels through the refrigerant heat exchanger 16, where it does not undergo heat exchange, and becomes a low-temperature, low-pressure gas refrigerant while removing heat, in the heat source side heat exchanger 12, from the outdoor air via the first expansion device 30 which is substantially fully open in terms of opening degree. The low-temperature, low-pressure gas refrigerant is again sucked into the compressor 10 via the refrigerant flow switching device 11 and the accumulator 13.

In a normal heating operation mode, the second expansion device 31 is closed. Furthermore, the opening degree of the third expansion device 22 is controlled so that subcool (the degree of subcooling), which is obtained as the difference between the value obtained by converting the pressure detected by the first pressure sensor 41 into the saturation temperature and the temperature detected by the fourth temperature sensor 46, becomes constant.

[Low-Outside-Temperature Heating Operation Mode]

Figure 4:
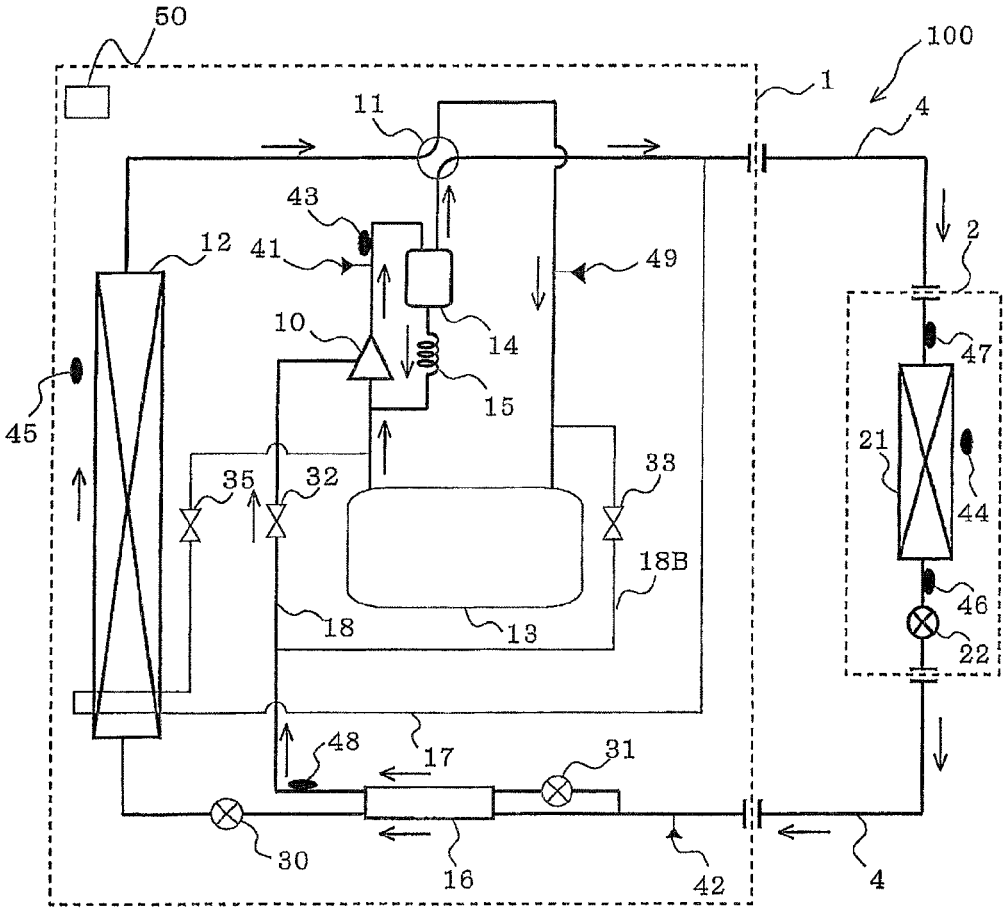
FIG. 4 is a refrigerant circuit diagram illustrating the flow of a refrigerant in a low-outside-temperature heating operation mode of the air-conditioning apparatus according to Embodiment 1 of the present invention.

FIG. 4 is a refrigerant circuit diagram illustrating the flow of a refrigerant in a low-outside-temperature heating operation mode of the air-conditioning apparatus 100 according to Embodiment 1. The low-outside-temperature heating operation mode is implemented when the outside air temperature is comparatively low (for example, −10 degrees C. or less). In FIG. 4, the direction of the flow of a refrigerant is indicated by a solid arrow.

In the low-outside-temperature heating operation mode illustrated in FIG. 4, a low-temperature, low-pressure refrigerant is compressed by the compressor 10 and becomes a high-temperature, high-pressure gas refrigerant which is then discharged. The high-temperature, high-pressure gas refrigerant discharged from the compressor 10 is separated by the oil separator 14 into a high-temperature, high-pressure gas refrigerant and a refrigerating machine oil, and only the high-temperature, high-pressure gas refrigerant flows out of the outdoor unit 1 via the refrigerant flow switching device 11. The refrigerating machine oil separated by the oil separator 14 flows in from the suction side of the compressor 10 via the oil return pipe 15.

The high-temperature, high-pressure gas refrigerant that has flowed out of the outdoor unit 1 travels through the main refrigerant pipe 4, transfers heat, in the use side heat exchanger 21, to the indoor air, and, as a result, becomes a liquid refrigerant while heating the indoor air. The liquid refrigerant flowing out of the use side heat exchanger 21 is expanded by the third expansion device 22 and becomes a low-temperature, intermediate-pressure two-phase or liquid refrigerant which travels through the main refrigerant pipe 4 and again flows into the outdoor unit 1. The low-temperature, intermediate-pressure two-phase or liquid refrigerant flowing into the outdoor unit 1 is branched at the inlet of the refrigerant heat exchanger 16 into a refrigerant that flows into the refrigerant heat exchanger 16 and a refrigerant that flows into the injection pipe 18.

The refrigerant that has flowed into the refrigerant heat exchanger 16 on the main refrigerant pipe 4 side transfers heat to the refrigerant on the injection pipe 18 side, which is a low-temperature, low-pressure two-phase refrigerant subjected to pressure reduction by the second expansion device 31, and becomes a further cooled low-temperature, intermediate-pressure liquid refrigerant. Then, the low-temperature, intermediate-pressure liquid refrigerant further cooled in the refrigerant heat exchanger 16 flows into the first expansion device 30, where it is subjected to pressure reduction, and then becomes a low-temperature, low-pressure gas refrigerant while removing heat, in the heat source side heat exchanger 12, from the outdoor air. The low-temperature, low-pressure gas refrigerant flowing out of the heat source side heat exchanger 12 is again sucked into the compressor 10 via the refrigerant flow switching device 11 and the accumulator 13.

On the other hand, the refrigerant that has flowed into the injection pipe 18 flows into the second expansion device 31, where it is subjected to pressure reduction, and becomes a low-temperature, low-pressure two-phase refrigerant. The low-temperature, low-pressure two-phase refrigerant then flows into the refrigerant heat exchanger 16, removes heat from the low-temperature, intermediate-pressure two-phase or liquid refrigerant, and, as a result, becomes a low-temperature, low-pressure two-phase refrigerant having a slightly high quality and having a higher pressure than the intermediate pressure of the compressor 10. The low-temperature, low-pressure two-phase refrigerant flowing out of the refrigerant heat exchanger 16 on the injection pipe 18 side is injected into the intermediate compression chamber in the compressor 10 via the first opening and closing device 32.

Here, the opening degree of the first expansion device 30 is controlled so that the pressure detected by the second pressure sensor 42 becomes equal to a given value (for example, approximately 1.0 MPa). The opening degree of the second expansion device 31 is controlled so that superheat (the degree of superheat), which is obtained as the difference between the value obtained by converting the pressure detected by the first pressure sensor 41 into the saturation temperature and the temperature detected by the first temperature sensor 43, becomes constant. The opening degree of the third expansion device 22 is controlled so that subcool (the degree of subcooling), which is obtained as the difference between the value obtained by converting the pressure detected by the first pressure sensor 41 into the saturation temperature and the temperature detected by the fourth temperature sensor 46, becomes constant.

[Effect of Low-Outside-Temperature Heating Operation Mode]

If a refrigerant is not injected into the compressor 10, the refrigerant needs to remove heat from the low-temperature outside air in the heat source side heat exchanger 12, causing a reduction in the evaporating temperature of the refrigerant. Thus, the density of the refrigerant that is sucked into the compressor 10 decreases.

If the density of the refrigerant that is sucked into the compressor 10 decreases, the flow rate of the refrigerant in the refrigeration cycle decreases, making it difficult to achieve sufficient heating capacity. If the density of the refrigerant that is sucked into the compressor 10 further decreases, a dilute refrigerant is compressed and heated. Accordingly, the temperature of the refrigerant discharged from the compressor 10 significantly increases.

However, the air-conditioning apparatus 100 implements the low-outside-temperature heating operation mode after implementing a low-outside-temperature heating operation start-up mode described below, ensuring that the reduction in the density of the refrigerant can be suppressed to achieve sufficient heating capacity and suppress an increase in discharge refrigerant temperature.

In the low-outside-temperature heating operation mode, the refrigerant that has removed heat in the heat source side heat exchanger 12 and that has become a low-temperature, low-pressure gas refrigerant flows into the compressor 10 via the accumulator 13. Then, the low-temperature, low-pressure gas refrigerant is compressed to an intermediate pressure by the compressor 10 and is heated before being fed into the intermediate compression chamber. On the other hand, a two-phase refrigerant flows into the intermediate compression chamber in the compressor 10 via the injection pipe 18.

That is, the refrigerant compressed to an intermediate pressure by the compressor 10 and the two-phase refrigerant that has flowed into the compressor 10 via the injection pipe 18 merge.

Hence, the refrigerant compressed to an intermediate pressure by the compressor 10 merges with a refrigerant for injection, resulting in a merged refrigerant being compressed to a high pressure, while the temperature is lower than that before injection, and then discharged. In the air-conditioning apparatus 100, therefore, the discharge refrigerant temperature of the compressor 10 is lower than that before injection, suppressing an abnormal increase in the discharge refrigerant temperature of the compressor 10.

Furthermore, the refrigerant compressed to an intermediate pressure by the compressor 10 has passed through the heat source side heat exchanger 12, and is therefore a low-temperature, low-pressure gas refrigerant that has removed heat in the heat source side heat exchanger 12. In contrast, the refrigerant for injection is a high-density two-phase refrigerant because it has not passed through the heat source side heat exchanger 12. Accordingly, injection can increase the density of the refrigerant compressed to an intermediate pressure by the compressor 10, and can increase the flow rate of the refrigerant in the refrigeration cycle, thereby achieving sufficient heating capacity even under a low outside temperature condition.

[Low-Outside-Temperature Heating Operation Start-Up Mode]

Figure 5:
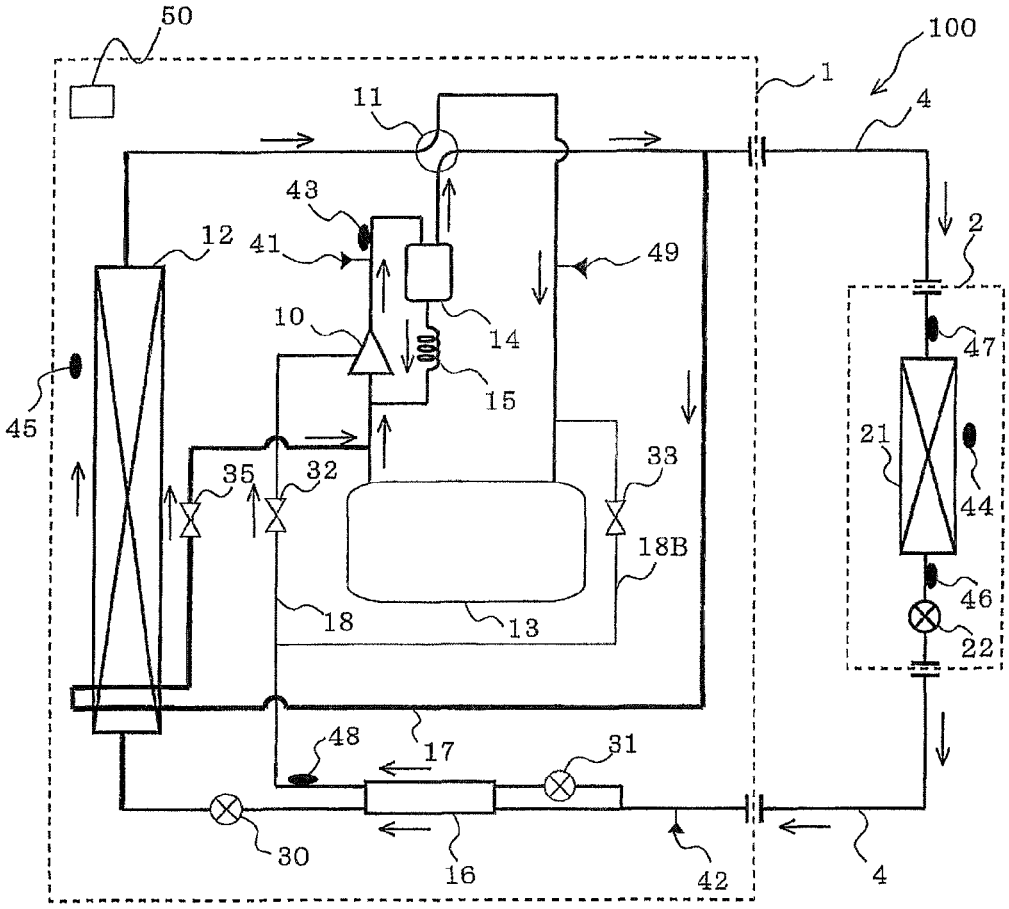
FIG. 5 is a refrigerant circuit diagram illustrating the flow of a refrigerant in a low-outside-temperature heating operation start-up mode of the air-conditioning apparatus according to Embodiment 1 of the present invention.

FIG. 5 is a refrigerant circuit diagram illustrating the flow of a refrigerant in a low-outside-temperature heating operation start-up mode of the air-conditioning apparatus 100 according to Embodiment 1. The low-outside-temperature heating operation mode is implemented when the outside air temperature is comparatively low (for example, −10 degrees C. or less). In FIG. 5, the direction of the flow of a refrigerant is indicated by a solid arrow.

The low-outside-temperature heating operation start-up mode is an operation mode implemented prior to the low-outside-temperature heating operation mode illustrated in FIG. 4 described above. That is, the low-outside-temperature heating operation start-up mode is followed by the low-outside-temperature heating operation mode described above.

In the low-outside-temperature heating operation start-up mode illustrated in FIG. 5, a low-temperature, low-pressure refrigerant is compressed by the compressor 10 and becomes a high-temperature, high-pressure gas refrigerant which is then discharged. The high-temperature, high-pressure gas refrigerant discharged from the compressor 10 is separated by the oil separator 14 into a high-temperature, high-pressure gas refrigerant and a refrigerating machine oil, and only the high-temperature, high-pressure gas refrigerant flows into the refrigerant flow switching device 11. The refrigerating machine oil separated by the oil separator 14 flows into a suction pipe of the compressor 10 via the oil return pipe 15.

Part of the high-temperature, high-pressure gas refrigerant that has flowed out of the refrigerant flow switching device 11 flows into the bypass pipe 17, and the remaining gas refrigerant flows out of the outdoor unit 1.

The high-temperature, high-pressure gas refrigerant that has flowed into the bypass pipe 17 flows into the heat source side heat exchanger 12, transfers heat to the outdoor air, and, as a result, becomes a low-temperature, high-pressure liquid refrigerant. The low-temperature, high-pressure liquid refrigerant then flows into the compressor 10 from the suction side of the compressor 10 via the third opening and closing device 35.

The remaining high-temperature, high-pressure gas refrigerant that has flowed out of the refrigerant flow switching device 11 travels through the main refrigerant pipe 4, and flows into the use side heat exchanger 21. Here, if the saturation temperature of the high-temperature, high-pressure gas refrigerant that has flowed into the use side heat exchanger 21 is higher than the temperature of the indoor air, the incoming refrigerant transfers heat to the indoor air and becomes a liquid refrigerant while heating the indoor air. If the saturation temperature of the high-temperature, high-pressure gas refrigerant that has flowed into the use side heat exchanger 21 is lower than the temperature of the indoor air, the incoming refrigerant removes heat from the indoor air and becomes a gas refrigerant whose temperature has increased.

The refrigerant that has flowed out of the use side heat exchanger 21 is expanded by the third expansion device 22 and becomes any of a low-temperature, intermediate-pressure two-phase refrigerant, a liquid refrigerant, and a gas refrigerant which then travels through the main refrigerant pipe 4 and again flows into the outdoor unit 1. The refrigerant flowing into the outdoor unit 1 is branched at the inlet of the refrigerant heat exchanger 16 into a refrigerant that flows into the refrigerant heat exchanger 16 and a refrigerant that flows into the injection pipe 18.

The refrigerant that has flowed into the refrigerant heat exchanger 16 on the main refrigerant pipe 4 side transfers heat to the refrigerant on the injection pipe 18 side, which is a low-temperature, low-pressure two-phase refrigerant subjected to pressure reduction by the second expansion device 31, and becomes a further cooled low-temperature, intermediate-pressure liquid refrigerant. Then, the low-temperature, intermediate-pressure liquid refrigerant further cooled in the refrigerant heat exchanger 16 flows into the first expansion device 30, where it is subjected to pressure reduction, and then becomes a low-temperature, low-pressure gas refrigerant while removing heat, in the heat source side heat exchanger 12, from the outdoor air. The low-temperature, low-pressure gas refrigerant flowing out of the heat source side heat exchanger 12 is again sucked into the compressor 10 via the refrigerant flow switching device 11 and the accumulator 13.

On the other hand, the refrigerant that has flowed into the injection pipe 18 flows into the second expansion device 31, where it is subjected to pressure reduction, and becomes a low-temperature, low-pressure two-phase refrigerant. The low-temperature, low-pressure two-phase refrigerant then flows into the refrigerant heat exchanger 16, removes heat from the low-temperature, intermediate-pressure two-phase or liquid refrigerant, and, as a result, becomes a low-temperature, low-pressure two-phase refrigerant having a slightly high quality and having a higher pressure than the intermediate pressure of the compressor 10. The low-temperature, low-pressure two-phase refrigerant flowing out of the refrigerant heat exchanger 16 on the injection pipe 18 side is injected into the intermediate compression chamber in the compressor 10 via the first opening and closing device 32.

Here, the opening degree of the first expansion device 30 is set so that the first expansion device 30 is substantially fully open in order to prevent a reduction in low-pressure pressure. The opening degree of the second expansion device 31 is controlled so that superheat (the degree of superheat), which is obtained as the difference between the value obtained by converting the pressure detected by the first pressure sensor 41 into the saturation temperature and the temperature detected by the first temperature sensor 43, becomes constant. The opening degree of the third expansion device 22 is set so that the third expansion device 22 is substantially fully open in order to prevent a reduction in low-pressure pressure.

[Effect of Low-Outside-Temperature Heating Operation Start-Up Mode]

For example, in a low outside temperature environment with an outside air temperature of approximately −10 degrees C. or less, the indoor temperature also decreases in accordance with the low outside air temperature. Accordingly, the saturation temperature of the high-pressure refrigerant is lower than the indoor air temperature for a period of approximately 5 to 15 minutes immediately after the start of an air-conditioning apparatus. Thus, even if a high-pressure refrigerant is supplied to a heat source side heat exchanger in the heating operation, the high-temperature, high-pressure gas refrigerant is not liquefied in the heat source side heat exchanger. That is, the gas refrigerant is supplied to a compressor via an injection pipe, resulting in a reduced effect of suppressing the increase in the temperature of the refrigerant discharged from the compressor.

Accordingly, in the process of increasing the rotation speed of the compressor and increasing high pressure, events such as an "abnormal increase in the temperature of the refrigerant discharged from the compressor", "deterioration of refrigerating machine oil", and "damage to the compressor caused by the deterioration of the refrigerating machine oil" may occur. In addition, if the rotation speed of the compressor decreases to prevent such events, the increase in the high pressure of the refrigerant may be delayed, resulting in an increase in the time taken to achieve sufficient heating capacity, leading to a "reduction in user comfort".

To address such inconvenience, the air-conditioning apparatus 100 implements a "low-outside-temperature heating operation start-up mode of injecting a refrigerant into the compressor 10 while reducing the temperature of a refrigerant that is discharged from the compressor 10" prior to a "low-outside-temperature heating operation mode of injecting a refrigerant into the compressor 10". This allows the air-conditioning apparatus 100 to suppress an increase in the temperature of the refrigerant to be discharged from the compressor 10 for a period of, for example, approximately 5 to 15 minutes immediately after the start of the air-conditioning apparatus 100, and can improve the effect of injection into the compressor 10.

More specifically, the air-conditioning apparatus 100 implements, prior to the low-outside-temperature heating operation mode, a low-outside-temperature heating operation start-up mode of causing part of the high-temperature, high-pressure gas refrigerant discharged from the compressor 10 to flow into the heat source side heat exchanger 12 via the bypass pipe 17. This allows the air-conditioning apparatus 100 to reduce the temperature of the refrigerant that flows into the suction side of the compressor 10 for a period of, for example, approximately 5 to 15 minutes immediately after the start of the air-conditioning apparatus 100, achieving "suppression of the abnormal increase in the discharge refrigerant temperature of the compressor 10", "prevention of deterioration of the refrigerating machine oil", and "prevention of damage to the compressor 10". Therefore, a "smooth increase in the rotation speed of the compressor 10" can be achieved.

Note that since the saturation temperature of the high-pressure refrigerant is higher than the indoor air temperature, for example, after approximately 5 to 15 minutes have passed immediately after the start of the air-conditioning apparatus 100, the air-conditioning apparatus 100 may transition from the "low-outside-temperature heating operation start-up mode" to the "low-outside-temperature heating operation mode" to increase the "amount of injection refrigerant" with respect to the "total amount of circulating refrigerant".

Figure 6:
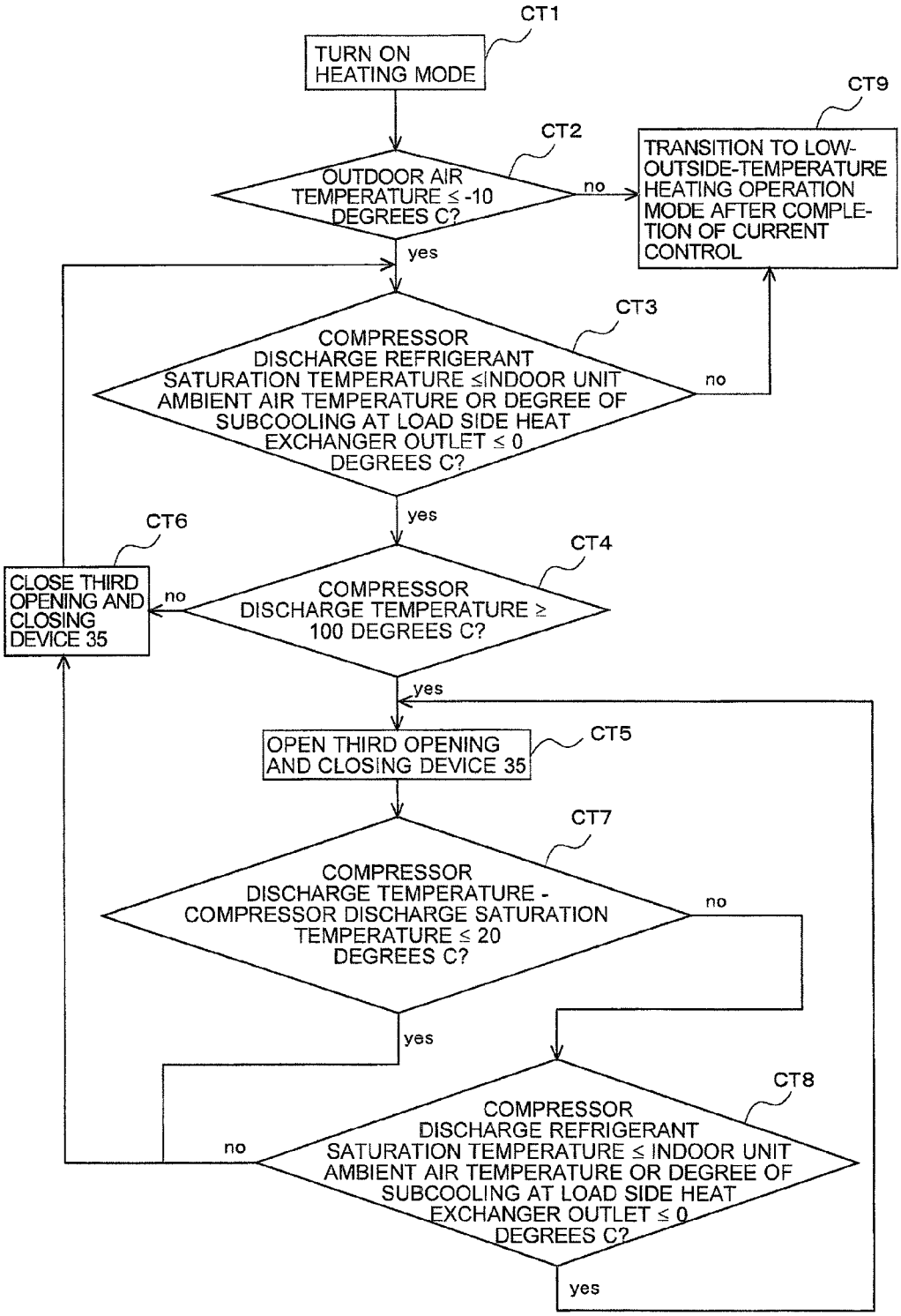
FIG. 6 is a flowchart illustrating a control operation in the low-outside-temperature heating operation start-up mode of the air-conditioning apparatus according to Embodiment 1 of the present invention.

FIG. 6 is a flowchart illustrating a control operation in the low-outside-temperature heating operation start-up mode of the air-conditioning apparatus 100 according to Embodiment 1. The operation of the controller 50 in the low-outside-temperature heating operation start-up mode will be described with reference to FIG. 6.

(CT1)

In response to receipt of a heating operation request from the indoor unit 2, the controller 50 executes a normal heating operation mode when the outside air temperature is in a given range of values (for example, 0 degrees C. to 10 degrees C.). When the outside air temperature is less than a given value (for example, less than 0 degrees C.), the controller 50 executes a low-outside-temperature heating operation start-up mode, and proceeds to CT2.

(CT2)

The controller 50 determines whether or not the outdoor air temperature detected by the second temperature sensor 45 is less than or equal to a given value (for example, less than or equal to −10 degrees C.). The given value corresponds to a second given value.

If the outdoor air temperature is less than or equal to the given value, the controller 50 proceeds to CT3.

If the outdoor air temperature is not less than or equal to the given value, the controller 50 proceeds to CT9, and executes the low-outside-temperature heating operation mode.

(CT3)

The controller 50 determines whether or not the condition that "the saturation temperature of the discharge refrigerant of the compressor 10 calculated from the pressure detected by the first pressure sensor 41 is less than or equal to the temperature detected by the sixth temperature sensor 44" or the condition that "subcool (the degree of subcooling), which is obtained as the difference between the value obtained by converting the pressure detected by the first pressure sensor 41 into the saturation temperature and an outlet temperature of the heat source side heat exchanger 12 detected by the fourth temperature sensor 46, is less than or equal to a given value (for example, less than or equal to 0 degrees C.)" is satisfied.

If one of the conditions is satisfied, the controller 50 proceeds to CT4.

If none of these conditions is satisfied, the controller 50 proceeds to CT9.

(CT4)

The controller 50 determines whether or not the discharge refrigerant temperature of the compressor 10 detected by the first temperature sensor 43 is greater than or equal to a given value (for example, greater than or equal to 100 degrees C.). The given value corresponds to a first given value.

If the refrigerant temperature is greater than or equal to the given value, the controller 50 proceeds to CT5.

If the refrigerant temperature is not greater than or equal to the given value, the controller 50 proceeds to CT6.

(CT5)

The controller 50 opens the third opening and closing device 35 to cause the refrigerant from the bypass pipe 17 to flow to the suction side of the compressor 10. Thus, the temperature of the discharge refrigerant of the compressor 10 can be reduced.

(CT6)

The controller 50 closes the third opening and closing device 35.

(CT7)

The controller 50 determines whether or not the superheat (the degree of superheat) of the discharge refrigerant of the compressor 10 is less than or equal to a given value (for example, less than or equal to 20 degrees C.). The superheat is calculated from the difference between the discharge refrigerant temperature of the compressor 10 detected by the first temperature sensor 43 and the saturation temperature of the discharge refrigerant of the compressor 10 calculated from the pressure detected by the first pressure sensor 41.

If the superheat (the degree of superheat) is less than or equal to the given value, the controller 50 proceeds to CT6.

If the superheat (the degree of superheat) is not less than or equal to the given value, the controller 50 proceeds to CT8.

If the superheat (the degree of superheat) is less than or equal to the given value in CT7, the controller 50 proceeds to CT6, and closes the third opening and closing device 35 to prevent an excessive amount of liquid refrigerant from flowing into the compressor 10. This can prevent a reduction in the density of the refrigerating machine oil inside the compressor 10, and can prevent damage to the compressor 10 due to the exhaustion of the refrigerating machine oil.

(CT8)

The controller 50 performs determination similar to the determination in CT3. Specifically, the controller 50 determines whether or not at least one of the conditions that "the saturation temperature of the discharge refrigerant of the compressor 10 calculated from the pressure detected by the first pressure sensor 41 is less than or equal to the temperature detected by the sixth temperature sensor 44" and "subcool (the degree of subcooling), which is obtained as the difference between the value obtained by converting the pressure detected by the first pressure sensor 41 into the saturation temperature and an outlet temperature of the heat source side heat exchanger 12 detected by the fourth temperature sensor 46, is less than or equal to a given value (for example, less than or equal to 0 degrees C.)" is satisfied.

If at least one of the conditions is satisfied, the controller 50 proceeds to CT5.

If none of these conditions is satisfied, the controller 50 proceeds to CT6.

(CT9)

The controller 50 closes the third opening and closing device 35 to terminate the control of the low-outside-temperature heating operation start-up mode, and then proceeds to the low-outside-temperature heating operation mode.

In the illustration of FIG. 6, the operation that proceeds to "the determination of CT4" after satisfying "the determination of CT2" and "the determination of CT3" has been described, by way of example. However, the embodiments herein are not limited to this operation. That is, control that proceeds to "the determination of CT4" from CT1 without performing "the determination of CT2" and "the determination of CT3" may be performed. Also in this low-outside-temperature heating operation start-up mode, an abnormal increase in the temperature of the refrigerant discharged from the compressor 10 can be suppressed, and the effect of preventing damage to the compressor 10 can be achieved.

Furthermore, in CT4, the discharge refrigerant temperature of the compressor 10 is set to 100 degrees C. or more, by way of example. However, the embodiments herein are not limited to this example. That is, the discharge refrigerant temperature of the compressor 10 may be set to, for example, approximately 120 degrees C. or more.

In addition, the given value of the temperature of the refrigerant discharged from the compressor 10, which is detected by the first temperature sensor 43, may be set so that the difference between the discharge refrigerant temperature of the compressor 10 detected by the first temperature sensor 43 and the saturation temperature of the discharge refrigerant of the compressor 10 calculated from the pressure detected by the first pressure sensor 41 is greater than or equal to, for example, approximately 20 degrees C. This can prevent an excessive amount of liquid refrigerant from flowing into the suction side of the compressor 10, while preventing the temperature of the gas refrigerant discharged from the compressor 10 from reaching, in the process of increasing the speed of the compressor 10, a temperature set so as to ensure that damage to the compressor 10 can be prevented, and can also prevent damage to the compressor 10 due to the exhaustion of the refrigerating machine oil in the compressor 10.

(Size Selection Method 1 for Third Opening and Closing Device 35 According to Embodiment 1)

Next, a description will be given of a method for appropriately selecting the size of the third opening and closing device 35 so as to prevent an excessive amount of liquid refrigerant from flowing into the suction side of the compressor 10 while ensuring that the discharge refrigerant temperature of the compressor 10 can be reduced.

It is assumed that the flow rate of a low-temperature, low-pressure gas refrigerant that flows into the suction side of the compressor 10 from the accumulator 13 is represented by $Gr_1$ (kg/h), and enthalpy is represented by $h_1$ (kJ/kg). Furthermore, it is assumed that the flow rate of a low-temperature, low-pressure liquid refrigerant that flows into the suction pipe of the compressor 10 from the heat source side heat exchanger 12 via the bypass pipe 17 is represented by $Gr_2$ (kg/h), and enthalpy is represented by $h_2$ (kJ/kg). Furthermore, it is assumed that the total flow rate of the refrigerant obtained after the refrigerants merge at the suction side of the compressor 10 is represented by Gr ($=Gr_1+Gr_2$) (kg/h), and enthalpy after merging is represented by h (kJ/kg). In this case, the energy conservation equation given in Expression (1) holds true.

[Math. 1]

$$Gr_1h_1+Gr_2h_2=Grh \tag{1}$$

The enthalpy h (kJ/kg) after merging, which is calculated using Expression (1), is lower than the enthalpy $h_1$ (kJ/kg) of the low-temperature, low-pressure gas refrigerant flowing into the suction side of the compressor 10 from the accumulator 13, resulting in the discharge temperature of the compressed refrigerant being lower than that when the liquid refrigerant from the bypass pipe 17 does not merge.

Here, the following assumptions are given for selecting the size of the third opening and closing device 35 (hereinafter also referred to as the assumptions for size selection method A): It is assumed that an equivalent adiabatic efficiency and an equivalent displacement are used to compress a refrigerant to a given pressure in the case of "'compressing the refrigerant having the enthalpy $h_1$ (kJ/kg) that is supplied to the suction side of the compressor 10 to a given pressure' while 'the third opening and closing device 35 is closed so as to block the refrigerant flowing into the suction side of the compressor 10 from the bypass pipe 17'" and in the case of "after 'refrigerants merge at the suction side of the compressor 10 and the enthalpy becomes equal to h (kJ/kg)', 'compressing the refrigerant having the enthalpy h (kJ/kg) to a given pressure' while 'the third opening and closing device 35 is open so as to cause the refrigerant to flow into the suction pipe of the compressor 10 from the bypass pipe 17'".

Then, the value of $Gr_2$ (kg/h) in Expression (1) is changed as desired, and the value of $Gr_2$ (kg/h), which is used to "reduce the temperature of the gas refrigerant", is calculated so that the discharge refrigerant temperature of the compressor 10 is "higher than the saturation temperature of the discharge refrigerant of the compressor 10 by approximately 10 degrees C. (corresponding to a third given value) or more". Then, the size of the third opening and closing device 35 is selected using the calculated $Gr_2$ (kg/h) and using the pressure difference between the pressure of the refrigerant discharged from the compressor 10 and the refrigerant pressure on the suction side of the compressor 10 in accordance with Expression (2) as follows.

[Math. 2]

$$Cv = 1.17Q\sqrt{\frac{\gamma}{P_1 - P_2}} \tag{2}$$

That is, the size of the third opening and closing device 35 may be determined so that "'the flow coefficient (Cv value) of the third opening and closing device 35' is less than or equal to approximately 0.01 when 'the displacement of the compressor 10 is in a range of' 15 $m^3$/h or more and less than 30 $m^3$/h", "'the flow coefficient (Cv value) of the third opening and closing device 35' is less than or equal to approximately 0.02' when 'the displacement of the compressor 10 is in a range of' 30 $m^3$/h or more and less than 40 $m^3$/h", and "'the flow coefficient (Cv value) of the third opening and closing device 35' is less than or equal to approximately 0.03 when 'the displacement of the compressor 10 is in a range of' 40 $m^3$/h or more and less than 60 $m^3$/h".

Here, in Expression (2), Q ($m^3$/h) represents the refrigerant flow rate of the refrigerant flowing through the bypass pipe 17, γ (–) represents specific gravity, $P_1$ (kgf/$cm^2$ abs) represents the pressure of the refrigerant discharged from the compressor 10, and $P_2$ (kgf/$cm^2$ abs) represents the refrigerant pressure inside the suction pipe of the compressor 10. Furthermore, the Cv value represents the capacity of the third opening and closing device 35. The Cv value, given that the refrigerant flowing into the third opening and closing device 35 is a liquid refrigerant, is computed from Expression (2).

Note that the source of Expression (2) is a publication published on "Jun. 30, 1998, fourth edition", written by "Valve Course Compilation Committee", published by "Sakutaro Kobayashi" from "Japan Industrial Publishing Co., Ltd.", titled "Shoho to jitsuyo no barubu kouza kaitei ban" ("Basics and Applications of Valve Course, Revised Edition").

(Size Selection Method 2 for Third Opening and Closing Device 35 According to Embodiment 1)

In (Size Selection Method 1 for Third Opening and Closing Device 35 according to Embodiment 1), a selection method is provided in which a size is obtained from the "assumptions for size selection method A" described above, substantially without taking into account the reduction in pressure due to friction loss in the bypass pipe 17. In (Size Selection Method 2 for Third Opening and Closing Device 35 according to Embodiment 1), the size of the third opening and closing device 35 may be selected using Expressions (3) and (4) below with also taking into account the friction loss that may vary in accordance with the pipe inside diameter and length of the bypass pipe 17.

Specifically, if the reduction in pressure due to friction loss in the bypass pipe 17 is as negligibly small as, for example, approximately 0.001 (MPa) or less, the size of the third opening and closing device 35 may be in the range of Cv values described above in (Size Selection Method 1 for Third Opening and Closing Device 35 according to Embodiment 1). On the other hand, if the reduction in pressure due to friction loss in part or whole of the bypass pipe 17 is large, the amount of liquid refrigerant flowing into the suction pipe of the compressor 10 from the bypass pipe 17 decreases, and the effect of suppressing an abnormal increase in the temperature of the gas refrigerant discharged from the compressor 10 is reduced. Accordingly, (Size Selection Method 2 for Third Opening and Closing Device 35 according to Embodiment 1) in which the size of the third opening and closing device 35 is selected to be large correspondingly may be employed.

In (Size Selection Method 2 for Third Opening and Closing Device 35 according to Embodiment 1), the sum of "the pressure loss in the bypass pipe 17 and the pressure loss in the third opening and closing device 35" is substantially equal to the difference between "the discharge gas refrigerant pressure of the compressor 10 and the refrigerant pressure on the suction side of the compressor 10". A specific description will be given hereinafter.

For example, according to the calculation based on the particulars given in (Size Selection Method 1 for Third Opening and Closing Device 35 according to Embodiment 1), a liquid refrigerant flow rate $Gr_2$ (kg/h) of approximately 44 (kg/h) is necessary to "reduce the temperature of the gas refrigerant" so that the discharge refrigerant temperature of the compressor 10 is higher than "the saturation temperature of the discharge refrigerant of the compressor 10 by approximately 10 degrees C. or more" in a case where the following conditions (A) and (B) are satisfied.

The condition (A) is that "a high-pressure liquid refrigerant at 1.2 (MPa abs) flows into a suction pipe at 0.2 MPa·abs via the bypass pipe 17".

The condition (B) is that "a gas refrigerant is discharged from the compressor 10 at a displacement with a force equivalent to 10 horse power (approximately 30 $m^3$/h)".

Here, as an example, it is assumed that a pipe having an inside diameter of 1.2 (mm) and a length of 1263 (mm) is connected to part of the bypass pipe 17 between the third opening and closing device 35 and a suction unit of the compressor 10 and that the pressure loss in the third opening and closing device 35 is represented by a. In this case, if a liquid refrigerant having a flow rate $Gr_2$ (kg/h) of approximately 44 (kg/h) flows, the "pressure loss ($P_1$–$P_2$ in Expression (3))" in the bypass pipe 17 is equal to approximately 0.999 (MPa abs) in accordance with Expressions (3) and (4) as follows.

[Math. 3]

$$\frac{(P_1 - P_2)}{\rho g} = \lambda \frac{L}{d} \frac{v^2}{2g} \tag{3}$$

[Math. 4]

$$\lambda = 0.3164 \times \frac{1}{Re^{\frac{1}{4}}} \tag{4}$$

That is, the pressure loss a in the third opening and closing device 35 is equal to 0.001 (MPa abs), which is calculated from the difference between 1.0 MPa, which is the difference between "the discharge gas refrigerant pressure of the compressor 10 and the refrigerant pressure on the suction side of the compressor 10", and 0.999 (MPa abs), which is the "pressure loss ($P_1$–$P_2$ in Expression (3))" in part of the bypass pipe 17. Then, calculating Q from $Gr_2$, which is 44 (kg/h), and substituting a (corresponding to $P_1$–$P_2$ in Expression (2)), which is set to 0.001, into Expression (2) can yield the result that the Cv value of the third opening and closing device 35 should preferably be greater than or equal to approximately 0.47.

As described above, (Size Selection Method 2 for Third Opening and Closing Device 35 according to Embodiment 1) ensures that the sum of "the pressure loss in the bypass pipe 17 and the pressure loss in the third opening and closing device 35" is substantially equal to the difference between "the discharge gas refrigerant pressure of the compressor 10 and the refrigerant pressure on the suction side of the compressor 10" and that "an amount of liquid refrigerant for compensating for the friction loss in the bypass pipe 17 can be maintained and the effect of suppressing the increase in the discharge refrigerant temperature of the compressor 10" can be achieved.

(Modification of Size Selection Method 2 for Third Opening and Closing Device 35 According to Embodiment 1)

In (Size Selection Method 2 for Third Opening and Closing Device 35 according to Embodiment 1), the description has been given in the context of a given pipe being prepared as the bypass pipe 17 and the "Cv value of the third opening and closing device 35" being calculated, by way of example. However, the embodiments herein are not limited to this example.

Specifically, the "Cv value of the third opening and closing device 35", the "pipe inside diameter of the bypass pipe 17", and the "length of the bypass pipe 17" may be determined so that the sum of the "pressure loss in the bypass pipe 17 and the pressure loss in the third opening and closing device 35" is substantially equal to the difference between the "discharge gas refrigerant pressure of the compressor 10 and the refrigerant pressure on the suction side of the compressor 10".

Note that Expression (3) is the well-known Darcy-Weisbach equation for pressure loss due to pipe friction of a pipe. In Expression (3), L (m) represents the length of the bypass pipe 17, d (m) represents the inside diameter of the bypass pipe 17, $P_1$ (Pa·abs) represents the pressure of the refrigerant discharged from the compressor 10, $P_2$ (Pa·abs) represents the refrigerant pressure inside the suction pipe of the compressor 10, g (m/$s^2$) represents gravitational acceleration, ρ represents the density (kg/$m^3$) of the liquid refrigerant flowing into the bypass pipe 17, and ν (m/s) represents the speed of the liquid refrigerant flowing into the bypass pipe 17. In addition, λ represents a pipe friction loss coefficient.

Expression (4) is the well-known Blasius equation for a pipe friction loss coefficient, and Re is the Reynolds number.

[Advantages of Air-Conditioning Apparatus 100 According to Embodiment 1]

The air-conditioning apparatus 100 according to Embodiment 1 is capable of executing the low-outside-temperature heating operation start-up mode, thus enabling a reduction in the temperature of the refrigerant flowing into the suction side of the compressor 10 for a period of, for example, approximately 5 to 15 minutes immediately after the start of the air-conditioning apparatus 100, achieving "suppression of an abnormal increase in the discharge refrigerant temperature of the compressor 10", "prevention of deterioration of refrigerating machine oil", and "prevention of damage to the compressor 10". The reliability of the air-conditioning apparatus 100 can be improved.

The air-conditioning apparatus 100 according to Embodiment 1 can achieve "suppression of an abnormal increase in the discharge refrigerant temperature of the compressor 10", "prevention of deterioration of refrigerating machine oil", and "prevention of damage to the compressor 10", and thus can "smoothly increase the rotation speed of the compressor 10", preventing an increase in the time taken to achieve sufficient heating capacity. Accordingly, the air-conditioning apparatus 100 according to Embodiment 1 can suppress a "reduction in user comfort".

Embodiment 2

Figure 7:
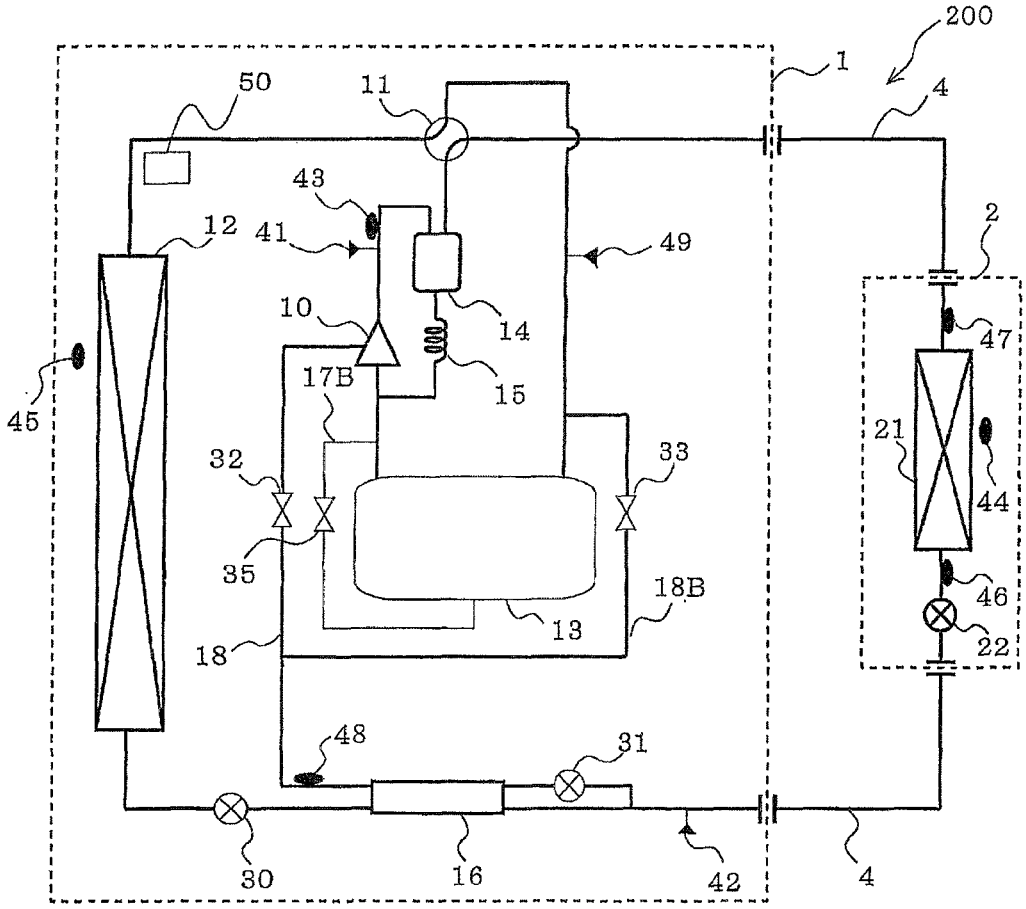
FIG. 7 is a schematic circuit configuration diagram illustrating an example of a circuit configuration of an air-conditioning apparatus according to Embodiment 2 of the present invention.

FIG. 7 is a schematic circuit configuration diagram illustrating an example of a circuit configuration of an air-conditioning apparatus (hereinafter referred to as 200) according to Embodiment 2. In Embodiment 2, a description will be focused on the difference from Embodiment 1 described above, and the same portions as those in Embodiment 1 are assigned the same numerals.

The configuration of the air-conditioning apparatus 200 illustrated in FIG. 7 is different from that of the air-conditioning apparatus 100 in terms of the configuration of the outdoor unit 1. Specifically, in the air-conditioning apparatus 200, the outdoor unit 1 has a connecting pipe 17B connected to a suction unit of the compressor 10 from the bottom of the accumulator 13 via the third opening and closing device 35. More specifically, the connecting pipe 17B has one side connected to the bottom of the accumulator 13, and the other side connected to a portion of the main refrigerant pipe 4 between the accumulator 13 and the suction side of the compressor 10. Unlike the bypass pipe 17, the connecting pipe 17B is installed in the outdoor unit 1 so as not to extend through the heat source side heat exchanger 12.

The air-conditioning apparatus 200 is configured to supply the liquid refrigerant reserved in the accumulator 13 to the suction side of the compressor 10 via the connecting pipe 17B and the third opening and closing device 35. That is, the air-conditioning apparatus 100 is configured to cause the refrigerant discharged from the compressor 10 to undergo heat exchange in the heat source side heat exchanger 12 to produce a liquid refrigerant which is then supplied to the suction side of the compressor 10, whereas the air-conditioning apparatus 200 is configured to supply the liquid refrigerant reserved in the accumulator 13 to the suction side of the compressor 10. The other operation and control of the air-conditioning apparatus 200 are similar to those of the air-conditioning apparatus 100.

Next, a description will be given of a method for selecting the size of the third opening and closing device 35 according to Embodiment 2. In the air-conditioning apparatus 200, the difference between the refrigerant pressures before and after the third opening and closing device 35 is smaller than that in the air-conditioning apparatus 100. Thus, the size of the third opening and closing device 35 needs to be selected to be larger than that in the air-conditioning apparatus 100. The selection method in Embodiment 2 is similar to that in Embodiment 1. The corresponding result in Embodiment 2 to Embodiment 1 described above (Size Selection Method 1 for Third Opening and Closing Device 35 according to Embodiment 2) is given below.

(Size Selection Method 1 for Third Opening and Closing Device 35 According to Embodiment 2)

The size of the third opening and closing device 35 may be determined so that "'the flow coefficient (Cv value) of the third opening and closing device 35' is less than or equal to approximately 0.15 when 'the displacement of the compressor 10 is in a range of' 15 $m^3/h$ or more and less than 30 $m^3/h$", "'the flow coefficient (Cv value) of the third opening and closing device 35' is less than or equal to approximately 0.20 when 'the displacement of the compressor 10 is in a range of' 30 $m^3/h$ or more and less than 40 $m^3/h$", and "'the flow coefficient (Cv value) of the third opening and closing device 35' is less than or equal to approximately 0.35 when 'the displacement of the compressor 10 is in a range of' 40 $m^3/h$ or more and less than 60 $m^3/h$".

(Size Selection Method 2 for Third Opening and Closing Device 35 According to Embodiment 2)

In (Size Selection Method 2 for Third Opening and Closing Device 35 according to Embodiment 2), the "Cv value of the third opening and closing device 35", the "pipe inside diameter of the connecting pipe 17B", and the "length of the connecting pipe 17B" are determined so that the sum of "the pressure loss in the connecting pipe 17B and the pressure loss in the third opening and closing device 35" is substantially equal to the "difference between the pressure inside the accumulator 13 and the pressure on the suction side of the compressor 10".

The calculation method is similar to that in (Size Selection Method 2 for Third Opening and Closing Device 35 according to Embodiment 1), and a description thereof is thus omitted.

[Advantages of Air-Conditioning Apparatus 200 according to Embodiment 2]

The air-conditioning apparatus 200 according to Embodiment 2 also achieves advantages similar to those of the air-conditioning apparatus 100 according to Embodiment 1.

Embodiment 3

Figure 8:
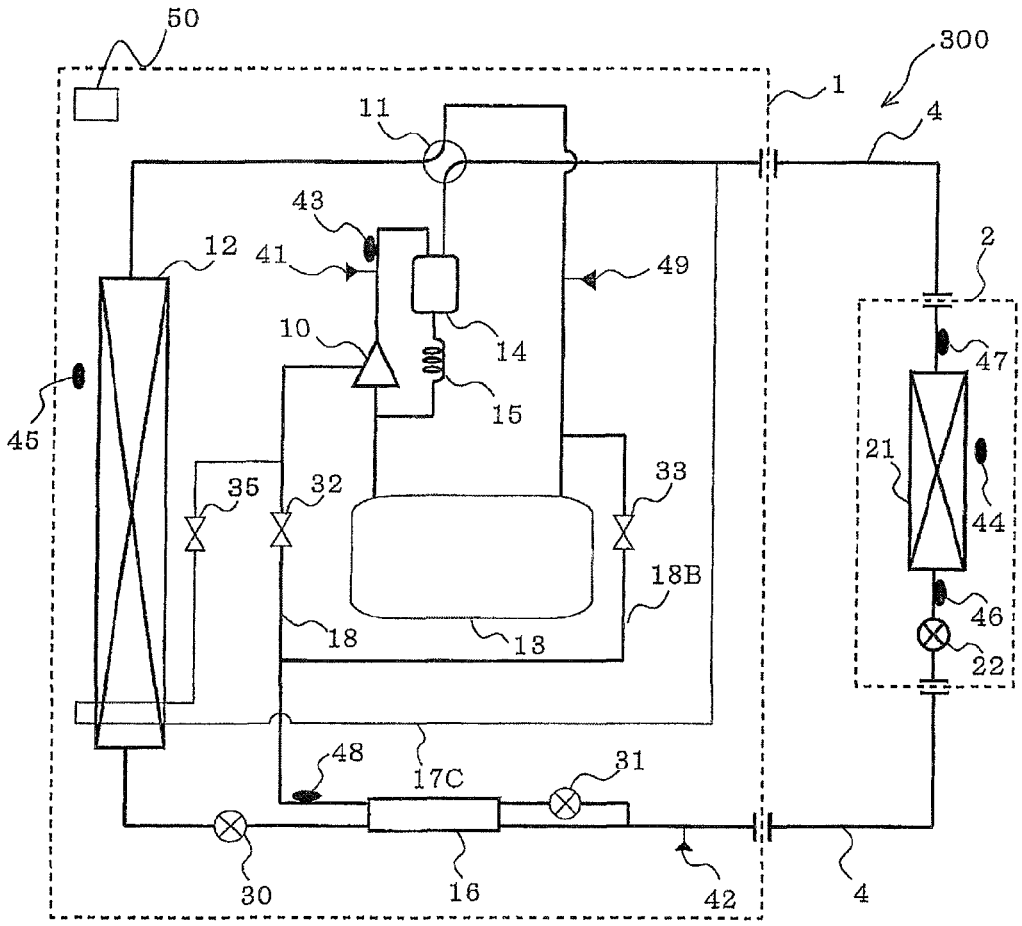
FIG. 8 is a schematic circuit configuration diagram illustrating an example of a circuit configuration of an air-conditioning apparatus according to Embodiment 3 of the present invention.

FIG. 8 is a schematic circuit configuration diagram illustrating an example of a circuit configuration of an air-conditioning apparatus (hereinafter referred to as 300) according to Embodiment 3. In Embodiment 3, a description will be focused on the difference from Embodiments 1 and 2 described above, and the same portions as those in Embodiments 1 and 2 are assigned the same numerals.

The configuration of the air-conditioning apparatus 300 illustrated in FIG. 8 is different from that of the air-conditioning apparatuses 100 and 200 in terms of the configuration of the outdoor unit 1. Specifically, in the air-conditioning apparatus 300, the outdoor unit 1 has a bypass pipe 17C connected to the injection pipe 18. More specifically, the bypass pipe 17C has one side connected to the main refrigerant pipe 4 connecting the refrigerant flow switching device 11 and the indoor unit 2, and the other side connected to a portion of the injection pipe 18 between the first opening and closing device 32 and the compressor 10. The bypass pipe 17C is provided to extend through the heat source side heat exchanger 12 so as to allow, similarly to the bypass pipe 17, the refrigerant flowing through the heat source side heat exchanger 12 to undergo heat exchange.

In the air-conditioning apparatus 300, a gas refrigerant discharged from the compressor 10 and flowing into the bypass pipe 17C is converted into a liquid refrigerant in the heat source side heat exchanger 12, which is then caused to flow into the injection pipe 18 via the bypass pipe 17C and the third opening and closing device 35. The refrigerant flowing into the injection pipe 18 from the bypass pipe 17C merges with the refrigerant flowing through the injection pipe 18, and the merged refrigerant is injected into the intermediate compression chamber in the compressor 10. The other operation and control of the air-conditioning apparatus 300 are similar to those of the air-conditioning apparatus 100.

(Size Selection Method 1 for Third Opening and Closing Device 35 According to Embodiment 3)

In Embodiment 3, instead of Expression (1) in Embodiment 1, Expression (5) below is used. Specifically, it is assumed that the enthalpy at which the low-temperature, low-pressure gas refrigerant flowing into the suction pipe of the compressor 10 from the accumulator 13 is compressed to intermediate pressure in the compressor 10 is represented by $h_3$ (kJ/kg), and the flow rate is represented by $Gr_3$ (kg/h). Furthermore, it is assumed that the flow rate of the low-temperature, intermediate-pressure refrigerant flowing into the intermediate compression chamber in the compressor 10 from the heat source side heat exchanger 12 via the third opening and closing device 35, the bypass pipe 17C, and the injection pipe 18 is represented by $Gr_o$ (kg/h), and enthalpy is represented by $h_4$ (kJ/kg). Furthermore, it is assumed that enthalpy after the respective refrigerants merge in the intermediate compression chamber in the compressor 10 is represented by $h_5$ (kJ/kg). In this case, the energy conservation equation given in Expression (5) holds true.

[Math. 5]

$$Gr_3h_3+Gr_4h_4=(Gr_3+Gr_4)h_5 \quad (5)$$

Here, in the air-conditioning apparatus 300, the difference between the refrigerant pressures before and after the third opening and closing device 35 is smaller than that in the air-conditioning apparatus 100. Thus, the size of the third opening and closing device 35 needs to be selected to be larger than that in the air-conditioning apparatus 100. The size of the third opening and closing device 35 in the air-conditioning apparatus 300 is selected using a technique similar to that in the air-conditioning apparatus 100.

The enthalpy $h_5$ (kJ/kg) after merging, which is calculated using Expression (5), is lowSer than the enthalpy $h_3$ (kJ/kg) of the low-temperature, low-pressure gas refrigerant flowing into the suction side of the compressor 10 from the accumulator 13, resulting in the discharge temperature of the compressed refrigerant being lower than that when the liquid refrigerant from the bypass pipe 17C does not merge.

Here, the following assumptions are given for selecting the size of the third opening and closing device 35 (hereinafter also referred to as the assumptions for size selection method B): it is assumed that an equivalent adiabatic efficiency and an equivalent displacement are used to compress a refrigerant to a given pressure in the case of "'compressing the refrigerant having the enthalpy $h_3$ (kJ/kg) that is supplied to the suction side of the compressor 10 to a given pressure' while 'the third opening and closing device 35 is closed so as to block the refrigerant flowing into the intermediate compression chamber in the compressor 10 from the bypass pipe 17C'" and in the case of "after 'refrigerants merge in the intermediate compression chamber and the enthalpy becomes equal to $h_5$ (kJ/kg)', 'compressing the refrigerant having the enthalpy $h_5$ (kJ/kg) to a given pressure' while 'the third opening and closing device 35 is open so as to cause the refrigerant to flow into the intermediate compression chamber in the compressor 10 from the bypass pipe 17C'".

Then, the value of $Gr_4$ (kg/h) in Expression (5) is changed as desired, and the value of $Gr_4$ (kg/h), which is used to "reduce the temperature of the gas refrigerant", is calculated so that the discharge refrigerant temperature of the compressor 10 is "higher than the saturation temperature of the discharge refrigerant of the compressor 10 by approximately 10 degrees C. or more". Then, the size of the third opening and closing device 35 is selected in accordance with Expression (2) described above using the calculated $Gr_4$ (kg/h) and using the pressure difference between the pressure of the refrigerant discharged from the compressor 10 and the refrigerant pressure on the suction side of the compressor 10 as follows.

The size of the third opening and closing device 35 may be determined so that "'the flow coefficient (Cv value) of the third opening and closing device 35' is less than or equal to approximately 0.02 when 'the displacement of the compressor 10 is in a range of' 15 $m^3$/h or more and less than 30 $m^3$/h", "'the flow coefficient (Cv value) of the third opening and closing device 35' is less than or equal to approximately 0.03 when 'the displacement of the compressor 10 is in a range of' 30 $m^3$/h or more and less than 40 $m^3$/h", and "'the flow coefficient (Cv value) of the third opening and closing device 35' is less than or equal to approximately 0.05 when 'the displacement of the compressor 10 is in a range of' 40 $m^3$/h or more and less than 60 $m^3$/h".

(Size Selection Method 2 for Third Opening and Closing Device 35 According to Embodiment 3)

In (Size Selection Method 1 according to Embodiment 3), a selection method is provided in which a size is selected from the "assumptions B for size selection method" described above, substantially without taking into account the reduction in pressure due to friction loss in the bypass pipe 17C. In (Size Selection Method 2 for Third Opening and Closing Device 35 according to Embodiment 3), the size of the third opening and closing device 35 may be selected using Expressions (3) and (4) described above with also taking into account the friction loss that may vary in accordance with the pipe inside diameter and length of the bypass pipe 17C.

Specifically, if the reduction in pressure due to friction loss in the bypass pipe 17C is as negligibly small as, for example, approximately 0.001 (MPa) or less, the size of the third opening and closing device 35 may be in the range of Cv values described above in (Size Selection Method 1). On the other hand, if the reduction in pressure due to friction loss in part or whole of the bypass pipe 17C is large, the amount of liquid refrigerant flowing into the intermediate compression chamber in the compressor 10 from the bypass pipe 17C decreases, and the effect of suppressing an abnormal increase in the temperature of the gas refrigerant discharged from the compressor 10 is reduced. Accordingly, (Size Selection Method 2) in which the size of the third opening and closing device 35 is selected to be large correspondingly may be employed.

In (Size Selection Method 2 for Third Opening and Closing Device 35 according to Embodiment 3), the sum of "the pressure loss in the bypass pipe 17C and the pressure loss in the third opening and closing device 35" is substantially equal to the difference between "the discharge gas refrigerant pressure of the compressor 10 and the refrigerant pressure in the intermediate compression chamber in the compressor 10". A specific description will be given hereinafter.

For example, according to the calculation based on the particulars given in (Size Selection Method 1 according to Embodiment 3), a liquid refrigerant flow rate $Gr_4$ (kg/h) of approximately 60 (kg/h) is necessary to "reduce the temperature of the gas refrigerant" so that the discharge refrigerant temperature of the compressor 10 is "higher than the saturation temperature of the discharge refrigerant of the compressor 10 by approximately 10 degrees C. or more" in a case where the following conditions (C) and (D) are satisfied.

The condition (C) is that "a high-pressure liquid refrigerant at 1.2 (MPa abs) flows into the intermediate compression chamber in the compressor 10 at 0.5 (MPa abs) via the bypass pipe 17C".

The condition (D) is that "a gas refrigerant is discharged from the compressor 10 at a displacement with a force equivalent to 10 horse power (approximately 30 $m^3$/h)".

Here, as an example, it is assumed that a pipe having an inside diameter of 1.2 (mm) and a length of 512 (mm) is connected to part of the bypass pipe 17C between the third opening and closing device 35 and the intermediate compression chamber in the compressor 10 and that the pressure loss in the third opening and closing device 35 is represented by β. In this case, if a liquid refrigerant having a flow rate $Gr_4$ (kg/h) of approximately 60 (kg/h) flows, the "pressure loss ($P_1-P_2$ in Expression (3))" in the bypass pipe 17C is equal to approximately 0.699 (MPa abs) in accordance with Expressions (3) and (4) above.

That is, the pressure loss β in the third opening and closing device 35 is equal to 0.001 (MPa abs), which is calculated from the difference between 0.7 (MPa abs), which is the difference between "the discharge gas refrigerant pressure of the compressor 10 and the refrigerant pressure in the intermediate compression chamber in the compressor 10", and 0.699 (MPa abs), which is the "pressure loss ($P_1-P_2$ in Expression (3))" in part of the bypass pipe 17C. Then, calculating Q from $Gr_4$, which is 60 (kg/h), and substituting β (corresponding to $P_1-P_2$ in Expression (2)), which is set to 0.001, into Expression (2) can yield the result that the Cv value of the third opening and closing device 35 should preferably be greater than or equal to approximately 0.64.

(Modification of Size Selection Method 2 for Third Opening and Closing Device 35 According to Embodiment 3)

In (Size Selection Method 2 for Third Opening and Closing Device 35 according to Embodiment 3), the description has been given in the context of a given pipe being prepared as the bypass pipe 17C and the "Cv value of the third opening and closing device 35" being calculated, by way of example. However, the embodiments herein are not limited to this example.

Specifically, the "Cv value of the third opening and closing device 35", the "pipe inside diameter of the bypass pipe 17C", and the "length of the bypass pipe 17C" may be determined so that the sum of "the pressure loss in the bypass pipe 17C and the pressure loss in the third opening and closing device 35" is substantially equal to the difference between the "discharge gas refrigerant pressure of the compressor 10 and the refrigerant pressure in the intermediate compression chamber in the compressor 10".

[Advantages of Air-Conditioning Apparatus 300 According to Embodiment 3]

The air-conditioning apparatus 300 according to Embodiment 3 also achieves advantages similar to the air-conditioning apparatus 100 according to Embodiment 1.

[Refrigerant]

In Embodiments 1 to 3, examples of the refrigerant circulating in the refrigeration cycle may include HFO1234yf, HFO1234ze(E), R32, HC, a refrigerant mixture of R32 and HFO01234yf, and a refrigerant that employs a refrigerant mixture containing at least one of the refrigerants described above, which may be used as a heat source side refrigerant. HFO1234ze has two geometric isomers, trans in which F and $CF_3$ are arranged at symmetric positions with respect to a double bond and cis in which F and CF3 are arranged at the same side of the double bond. HFO1234ze(E) in Embodiments 1 to 3 is of the trans type. The IUPAC system of nomenclature is trans-1,3,3,3-tetrafluoro-1-propene.

[Third Opening and Closing Device]

The third opening and closing device 35 of Embodiments 1 to 3 has been described in the context of a solenoid valve, by way of example. As an alternative to a solenoid valve, a valve having a variable opening degree, such as an electronic expansion valve, may also be used as an opening and closing valve.

As described above, in Embodiments 1 to 3, in a low-outside-temperature heating operation start-up mode, it is possible to suppress an abnormal increase in the temperature of the high-temperature, high-pressure gas refrigerant discharged from the compressor 10, improve reliability against deterioration of refrigerating machine oil or damage to the compressor 10, smoothly increase the speed of the compressor 10, and reduce the time taken to achieve sufficient heating capacity under a low outside temperature condition.

Furthermore, in general, the heat source side heat exchanger 12 and the use side heat exchanger 21 are each provided with a fan, which usually provides air flow to induce condensation or evaporation. However, the embodiments herein are not limited to this configuration. For example, a panel heater or the like that utilizes radiation may be used as the use side heat exchanger 21, and the heat source side heat exchanger 12 may be of a water-cooled type in which heat is transferred using water or antifreeze. That is, the heat source side heat exchanger 12 and the use side heat exchanger 21 may be of any type configured to transfer heat or remove heat.

The circuit configuration of Embodiments 1 to 3 has been described in the context of a refrigerant being caused to flow directly into the use side heat exchanger 21 installed in the indoor unit 2 to cool or heat the indoor air, by way of example. However, the embodiments herein are not limited to this configuration. A circuit configuration may also be used in which heating energy or cooling energy of a refrigerant generated in the outdoor unit 1 is caused to undergo heat exchange with a heat medium such as water or antifreeze by using an intermediate heat exchanger such as a double-pipe or plate-type heat exchanger, and the heat medium such as water or antifreeze is cooled or heated, and is caused to flow into the use side heat exchanger 21 by using heat medium conveying means such as a pump so that the indoor air is cooled or heated using the heat medium.

The invention claimed is:

1. An air-conditioning apparatus having a refrigeration cycle in which a compressor, a refrigerant flow switching device, a heat source side heat exchanger, a use side expansion device, and a use side heat exchanger are connected to one another using a refrigerant pipe, the air-conditioning apparatus comprising:

an injection pipe having one side connected to an injection port of the compressor, and another side connected to the refrigerant pipe between the use side expansion device and the heat source side heat exchanger, the injection pipe being configured to inject a refrigerant during a compression operation of the compressor;

a refrigerant heat exchanger configured to exchange heat between the refrigerant flowing through a refrigerant pipe in the refrigeration cycle and the refrigerant flowing through the injection pipe;

a connecting pipe having one side connected to the refrigerant pipe between the refrigerant flow switching device and the use side heat exchanger, and another side connected to a suction side of the compressor, the connecting pipe being configured to direct part of a discharge refrigerant from the compressor to the heat source side heat exchanger and then to cause the part of the discharge refrigerant to flow into the suction side of the compressor;

an opening and closing device disposed in the connecting pipe and capable of switching between opening and closing of a passage in the connecting pipe;

a first temperature sensor configured to detect a temperature on a discharge side of the compressor; and a controller configured to switch the opening and closing device in accordance with a detection result of the first temperature sensor, wherein the controller is configured to perform a low-outside-temperature heating operation start-up mode when an outside temperature is a predetermined low temperature in a case where the detection result of the first temperature sensor is greater than or equal to a preset first predetermined value, and a low-outside-temperature heating operation mode after performing the low-outside-temperature heating operation start-up mode, wherein during the low-outside-temperature heating operation start-up mode, the opening and closing device is opened, a part of the refrigerant discharged from the compressor flows into the use side heat exchanger, a part of the refrigerant flowing out from the use side heat exchanger flows into the injection port of the compressor via the injection pipe, a rest of the refrigerant discharged from the compressor flows into a suction side of the compressor via the connecting pipe, and wherein during the low-outside-temperature heating operation mode, the opening and closing device is closed, the refrigerant discharged from the compressor flows into the use side heat exchanger, the part of the refrigerant flowing out from the use side heat exchanger flows into the injection port of the compressor via the injection pipe.

2. The air-conditioning apparatus of claim 1, further comprising:

an outdoor unit including at least the compressor and the heat source side heat exchanger;

an indoor unit including at least the use side heat exchanger;

a second temperature sensor configured to detect an ambient air temperature of the outdoor unit;

a third temperature sensor configured to detect a suction air temperature of the indoor unit; and a pressure sensor configured to detect a refrigerant pressure on the discharge side of the compressor, wherein the controller is configured to perform the low-outside-temperature heating operation start-up mode when (a) the outside temperature is the predetermined low temperature in a case where (b) the detection result of the first temperature sensor is greater than or equal to the preset first predetermined value, (c) a detection result of the second temperature sensor is less than or equal to a preset second predetermined value and (d) a refrigerant saturation temperature calculated from a detection result of the pressure sensor is lower than a detection result of the third temperature sensor.

3. The air-conditioning apparatus of claim 2, wherein the controller closes the opening and closing device, and transitions from the low-outside-temperature heating operation start-up mode to the low-outside-temperature heating operation mode in a case where the detection result of the second temperature sensor is greater than the preset second predetermined value or in a case where the detection result of the second temperature sensor is less than or equal to the preset second predetermined value and the refrigerant saturation temperature calculated from the detection result of the pressure sensor is higher than the detection result of the third temperature sensor.

4. The air-conditioning apparatus of claim 1, wherein the controller controls an opening degree of the opening and closing device to adjust a refrigerant flow rate of refrigerant flowing in the connecting pipe so that the detection result of the first temperature sensor to be higher than a saturation temperature of the discharge refrigerant of the compressor by a third predetermined value or more.

5. The air-conditioning apparatus of claim 4, wherein a capacity of the opening and closing device, an inside diameter of the connecting pipe, and a length of the connecting pipe are determined so that a sum of a drop in refrigerant pressure caused by a flow of refrigerant having the refrigerant flow rate through the opening and closing device and a drop in refrigerant pressure caused by a flow of refrigerant having the refrigerant flow rate through the connecting pipe is equal to a pressure difference that is a difference between a refrigerant pressure on the discharge side of the compressor and a refrigerant pressure on a suction side of the compressor or a refrigerant pressure inside the injection port.

6. The air-conditioning apparatus of claim 5, wherein in a case where the third predetermined value is 10 degrees C., when a capacity of the opening and closing device, which is calculated from the pressure difference and the refrigerant flow rate, is denoted by a Cv value, and a total amount of refrigerant that flows out of the discharge side of the compressor is denoted by a displacement, the Cv value is less than or equal to 0.01 when the displacement is 15 $m^3/h$ or more and less than 30 $m^3/h$, the Cv value is less than or equal to 0.02 when the displacement is 30 $m^3/h$ or more and less than 40 $m^3/h$, and the Cv value is less than or equal to 0.03 when the displacement is 40 $m^3/h$ or more and less than 60 $m^3/h$.

7. The air-conditioning apparatus of claim 1, wherein the refrigerant that circulates in the refrigeration cycle is HFO1234yf, HFO1234ze(E), R32, HC, a refrigerant mixture of R32 and HFO1234yf, or a refrigerant mixture including at least one of the named refrigerants.

* * * * *